US008588656B2

(12) United States Patent
Mihara et al.

(10) Patent No.: US 8,588,656 B2
(45) Date of Patent: Nov. 19, 2013

(54) DEVELOPING DEVICE WITH DOUBLE SPIRAL BLADE AND IMAGE FORMING APPARATUS

(75) Inventors: Koichi Mihara, Osaka (JP); Takafumi Nagai, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 261 days.

(21) Appl. No.: 13/110,428

(22) Filed: May 18, 2011

(65) Prior Publication Data

US 2011/0286769 A1 Nov. 24, 2011

(30) Foreign Application Priority Data

May 18, 2010 (JP) ..... P2010-114798

(51) Int. Cl.
*G03G 15/08* (2006.01)

(52) U.S. Cl.
USPC ..... 399/254; 399/255; 399/256; 399/258; 399/262; 399/263

(58) Field of Classification Search
USPC ..... 399/254, 246, 263, 256
See application file for complete search history.

(56) References Cited

U.S. PATENT DOCUMENTS

| | | | | |
|---|---|---|---|---|
| 4,739,907 | A * | 4/1988 | Gallant | 222/240 |
| 6,577,834 | B2 * | 6/2003 | Suzuki | 399/254 |
| 6,585,406 | B2 * | 7/2003 | Toepper et al. | 366/320 |
| 6,615,014 | B2 | 9/2003 | Sugihara et al. | |
| 7,137,730 | B2 * | 11/2006 | Eck et al. | 366/320 |
| 7,311,438 | B2 * | 12/2007 | Kim et al. | 366/295 |
| 7,426,361 | B2 * | 9/2008 | Thompson et al. | 399/254 |
| 7,647,009 | B2 * | 1/2010 | Deguchi et al. | 399/254 |
| 7,979,007 | B2 * | 7/2011 | Mihara et al. | 399/254 |
| 8,270,882 | B2 * | 9/2012 | Mihara et al. | 399/256 |
| 8,340,554 | B2 * | 12/2012 | Morimoto et al. | 399/256 |
| 8,417,158 | B2 * | 4/2013 | Tanaka | 399/258 |
| 8,422,919 | B2 * | 4/2013 | Eck et al. | 399/254 |
| 8,422,920 | B2 * | 4/2013 | Tanaka | 399/258 |
| 2005/0123321 | A1 * | 6/2005 | Buhay-Kettelkamp et al. | 399/254 |
| 2007/0217827 | A1 * | 9/2007 | Tsuji et al. | 399/258 |
| 2008/0025763 | A1 * | 1/2008 | Suenami | 399/256 |
| 2008/0240791 | A1 * | 10/2008 | Thompson et al. | 399/254 |
| 2010/0196058 | A1 * | 8/2010 | Mihara et al. | 399/256 |

(Continued)

FOREIGN PATENT DOCUMENTS

| | | |
|---|---|---|
| JP | 11-160987 | 6/1999 |
| JP | 2001-255723 | 9/2001 |

(Continued)

*Primary Examiner* — David Gray
*Assistant Examiner* — Geoffrey Evans
(74) *Attorney, Agent, or Firm* — Nixon & Vanderhye P.C.

(57) ABSTRACT

A developer tank of a developing device is partitioned into a first conveyance path, a second conveyance path, a first communicating path and a second communicating path with a partition. A first developer conveying member that conveys a developer in a first developer conveying direction is provided in the first conveyance path. A second developer conveying member that conveys the developer in a second developer conveying direction is provided in the second conveyance path. In the first developer conveying member, a double spiral blade is provided on a downstream side in the first developer conveying direction from a first conveying blade of the first developer conveying member, the double spiral blade including an inner spiral blade that conveys the developer in a first direction and an outer spiral blade that conveys the developer in a second direction.

8 Claims, 16 Drawing Sheets

(56) References Cited

U.S. PATENT DOCUMENTS

| | | | | |
|---|---|---|---|---|
| 2010/0226689 | A1* | 9/2010 | Mihara | 399/254 |
| 2011/0170911 | A1 | 7/2011 | Yoshimoto et al. | |
| 2011/0229213 | A1* | 9/2011 | Mihara et al. | 399/263 |
| 2011/0255907 | A1* | 10/2011 | Mihara et al. | 399/263 |
| 2011/0286770 | A1* | 11/2011 | Hayashi et al. | 399/254 |
| 2012/0045252 | A1* | 2/2012 | Mihara et al. | 399/254 |
| 2012/0189353 | A1* | 7/2012 | Mihara et al. | 399/258 |
| 2012/0328334 | A1* | 12/2012 | Mihara et al. | 399/255 |

FOREIGN PATENT DOCUMENTS

| | | |
|---|---|---|
| JP | 2004-126325 | 4/2004 |
| JP | 2005-258300 | 9/2005 |
| JP | 2009-109741 | 5/2009 |
| JP | 2009-237142 | 10/2009 |
| JP | 2010-72279 | 4/2010 |

* cited by examiner

DEVELOPING DEVICE WITH DOUBLE SPIRAL BLADE AND IMAGE FORMING APPARATUS

CROSS-REFERENCE TO RELATED APPLICATION

This application claims priority to Japanese Patent Application No. 2010-114798, which was filed on May 18, 2010, the contents of which are incorporated herein by reference in its entirety.

BACKGROUND OF THE TECHNOLOGY

1. Field of the Technology

The present technology relates to a developing device and an image forming apparatus.

2. Description of the Related Art

A copier, a printer, a facsimile or the like is provided with an image forming apparatus which forms an image by means of electrophotography. The electrophotographic image forming apparatus forms an image by forming an electrostatic latent image on a surface of a photoreceptor drum by a charging device and an exposure device, developing the electrostatic latent image by supplying a toner with the developing device, transferring a toner image on the photoreceptor drum to a recording medium such as a recoding sheet by a transfer section, and fixing the toner image on the recording sheet with a fixing device.

The toner supplied to the photoreceptor drum by the developing device is stored in a developer tank provided in the developing device as a developer. The developer stored in the developer tank is conveyed to a developing roller provided in the developing device. The developing roller bears the developer on a surface thereof and rotates so that the developer is conveyed to a vicinity of the photoreceptor drum. The toner contained in the developer is frictionally charged in a process of being conveyed to the developing roller, and the charged toner is moved onto the photoreceptor drum from the surface of the developing roller with an electrostatic force generated with an electrostatic latent image on a surface of the photoreceptor drum. In this way, the developing device develops the electrostatic latent image on the surface of the photoreceptor drum to form the toner image.

As a type of conveying a developer to a developing roller in a developing device, a circulation type has been employed conventionally. A developing device of circulation type has a partition, provided in a developer tank thereof, for partitioning an inside of the developer tank into a conveyance path facing a developing roller, another conveyance path opposed to the conveyance path with the partition interposed therebetween, and two communicating paths communicating with the two conveyance paths at both ends in a longitudinal direction thereof, and in each of the conveyance paths, a developer conveying member is provided for conveying a developer in an opposite direction to each other. Then, by the two developer conveying members, the developer is circulated and conveyed through a first conveyance path, a first communicating path, a second conveyance path, and a second communicating path, in this order.

Japanese Unexamined Patent Publication JP-A 2001-255723 describes a developing device of circulation type with two developer conveying members whose numbers of spirals are different from each other. According to JP-A 2001-255723, differentiating the numbers of the spirals between the two developer conveying members enables suppression of repelling of the developer in the two developer conveying members, so that the developer can be circulated and conveyed smoothly. Furthermore, Japanese Unexamined Patent Publication JP-A 2009-109741 describes a developing device of circulation type having a developer conveying member provided with a reverse spiral blade with a through hole formed therein for conveying a developer in an opposite direction to a developer conveying direction, downstream in a developer conveying direction on a spiral blade of the developer conveying member. According to JP-A 2009-109741, the reverse spiral blade with the through hole formed therein generates convection of the developer downstream in the developer conveying direction, thereby making it possible to prevent retention of the developer.

Even in the developing device described in JP-A 2001-255723, and even in the developing device described in JP-A 2009-109741, in order to move the developer from the conveyance path to the communicating path to circulate the developer, a pressure is needed to be generated on the developer. That is, in the developing device described in JP-A 2001-255723 generates a pressure on the developer by compressing the developer with the developer conveying member and an inner wall of a developer tank in a conveyance path so that the developer is moved toward a communicating path which lies in a direction in which the pressure on the developer is lowered. Moreover, the developing device described in JP-A 2009-109741 generates a pressure on the developer by compressing the developer with the spiral blade of the developer conveying member and the reverse spiral blade of the developer conveying member in a conveyance path so that the developer is moved toward a communicating path which lies in a direction in which the pressure on the developer is lowered.

In a developing device for moving the developer to the communicating path by generating the pressure on the developer in this way, there is a problem that a load to the developer is great so that degradation of an image quality is caused. For example, in a case where a toner contained in the developer is a toner externally added with a fluidity improvement agent, when the toner is compressed excessively by the developer conveying member, the fluidity improvement agent is immersed into a surface of the toner and fluidity of the toner is reduced extremely so that conveyance and sufficient charging of the toner are difficult. As a result, a sufficient amount of the toner cannot be supplied to the photoreceptor drum, thus lowering an image concentration of a formed image.

SUMMARY OF THE TECHNOLOGY

The technology is to solve the above-described problem, and an object thereof is to provide a developing device and an image forming apparatus capable of circulating and conveying a developer while suppressing a load applied to the developer in a developer tank.

The technology provides a developing device comprising:

a developer tank that stores a developer;

a partition that partitions an internal space of the developer tank into a first conveyance path along a longitudinal direction of the partition, a second conveyance path opposing to the first conveyance path with the partition interposed therebetween, and first and second communicating paths communicating with the first conveyance path and the second conveyance path at both ends in the longitudinal direction of the partition;

a first developer conveying member that is provided in the first conveyance path, and has a first rotation shaft which rotates around an axial line thereof, and a first conveying blade provided around the first rotation shaft, the first developer conveying member conveying the developer stored in the developer tank in a first developer conveying direction along the axial line of the first rotation shaft with rotation motion of the first conveying blade following rotation of the first rotation shaft;

a second developer conveying member that is provided in the second conveyance path, and has a second rotation shaft which rotates around an axial line thereof, and a second conveying blade provided around the second rotation shaft, the second developer conveying member conveying the developer stored in the developer tank in a second developer conveying direction, which is opposite to the first developer conveying direction, along the axial line of the second rotation shaft with rotation motion of the second conveying blade following rotation of the second rotation shaft;

a double spiral blade that is provided facing the first communicating path on a downstream side from the first conveying blade of the first developer conveying member in the first developer conveying direction, and comprises an inner spiral blade that is provided around the first rotation shaft of the first developer conveying member and conveys the developer stored in the developer tank in a first direction among axial line directions of the first rotation shaft with rotation motion following rotation of the first rotation shaft, and an outer spiral blade that is provided around the inner spiral blade and conveys the developer stored in the developer tank in a second direction among the axial line directions; and a developing roller that bears and conveys the developer.

The developer in the developer tank is conveyed in the first direction among axial line directions of the first rotation shaft with an inner spiral blade provided around the first rotation shaft at a position relatively near to the first rotation shaft of the first developer conveying member, and at the same time, conveyed in the second direction among the axial line directions with an outer spiral blade provided around the inner spiral blade at a position relatively far from the first rotation shaft. In this manner, the double spiral blade having the inner spiral blade and the outer spiral blade generates two flows of the developer whose directions are different from each other around a position where the double spiral blade is provided in the first rotation shaft, at the same time. The two flows of the developer whose directions are different from each other repel from each other so that the developer which is at a position that is relatively far from the first rotation shaft is biased in a direction that separates from the first rotation shaft. Thereby, the developer can be guided to the first communicating path without causing an excessive pressure to be generated against the developer, and the developer can be circulated and conveyed while suppressing a load applied to the developer.

Further, it is preferable that the first developer conveying member is configured so that the first developer conveying direction is a same direction as the first direction.

The first developer conveying member is configured so that the first developer conveying direction in which a developer is conveyed with the first conveying blade is the same direction as a direction in which a developer is conveyed with the inner spiral blade. Accordingly, the outer spiral blade conveys the developer in an opposite direction to the first developer conveying direction at a position that is relatively far from the first rotation shaft. Then, the inner spiral blade conveys the developer toward an inner wall of the developer tank at a position that is relatively near to the first rotation shaft. At the time, the developer conveyed with the inner spiral blade is to go to a vertically lower side, that is, toward the external spiral blade, under its own weight. Therefore, compression of the developer with the inner wall of the developer tank and the inner spiral blade is suppressed, and it is thus possible to suppress the load applied to the developer.

Further, it is preferable that the inner spiral blade is a cone-shaped general spiral blade whose internal diameter is constant and external diameter becomes continuously smaller as advancing in the first direction, and the outer spiral blade is an annular general spiral blade whose external diameter is constant and internal diameter becomes continuously larger as advancing in the second direction.

The inner spiral blade is a cone-shaped general spiral blade whose external diameter becomes continuously smaller, and the outer spiral blade is an annular general spiral blade whose internal diameter becomes continuously larger. Since the inner spiral blade is a cone-shaped general spiral blade, an amount of the developer conveyed in the first direction among the axial line directions of the first rotation shaft of the first developer conveying member becomes smaller gradually. Since the outer spiral blade is an annular general spiral blade, an amount of the developer conveyed in the second direction among the axial line directions of the first rotation shaft of the first developer conveying member becomes smaller gradually. In this way, in the double spiral blade, in a place where the amount of the developer conveyed in the first direction is large, the amount of the developer conveyed in the second direction is small, and in a place where the amount of the developer conveyed in the second direction is large, the amount of the developer conveyed in the first direction is small. Thereby, occurrence of a rapid repelling due to the above-described two flows of the developer whose directions are different from each other is suppressed so that the load applied to the developer with the repelling can be suppressed.

Further, it is preferable that the first developer conveying member is configured so that the first developer conveying direction is a same direction as the second direction, the inner spiral blade is a cone-shaped general spiral blade whose internal diameter is constant and external diameter becomes continuously smaller as advancing in the first direction, and the outer spiral blade is an annular general spiral blade whose external diameter is constant and internal diameter becomes continuously larger as advancing in the second direction.

The inner spiral blade is the cone-shaped general spiral blade whose external diameter becomes continuously smaller and the outer spiral blade is the annular general spiral blade whose internal diameter becomes continuously larger. Since the inner spiral blade is the cone-shaped general spiral blade, an amount of the developer conveyed in the first direction among the axial line directions of the first rotation shaft of the first developer conveying member becomes smaller gradually. Since the outer spiral blade is the annular general spiral blade, an amount of the developer conveyed in the second direction among the axial line directions of the first rotation shaft of the first developer conveying member becomes smaller gradually. The second direction is the same as the first developer conveying direction and is a direction advancing toward the inner wall of the developer tank. As described above, the amount of the developer conveyed in the second direction becomes smaller as advancing in the second direction, that is, as advancing toward the inner wall of the developer tank. Thereby, it is possible to suppress compression of the developer with the inner wall of the developer tank and the outer spiral blade so that a load applied to the developer can be suppressed.

Further, in a place where the amount of the developer conveyed in the first direction is large, the amount of the developer conveyed in the second direction is small, and in a place where the amount of the developer conveyed in the second is large, the amount of the developer conveyed in the first direction is small. Thereby, occurrence of rapid repelling due to the above-described two flows of the developer whose directions are different from each other is suppressed so that the load applied to the developer with repelling can be suppressed.

Further, it is preferable that the first developer conveying member is configured so that a rotation direction of the first rotation shaft of the first conveying member, when viewed in the first developer conveying direction, is a right-handed direction when a direction of a flow of the developer stored in the developer tank is a right-handed direction in a case of being viewed from a vertically upper side of the developer tank, and a left-handed direction when a direction of a flow of the developer stored in the developer tank is a left-handed direction in a case of being viewed from a vertically upper side of the developer tank.

The first developer conveying member is configured so that a rotation direction of the first rotation shaft when viewed in the first developer conveying direction coincides with a direction of a flow of the developer in the case of being viewed from the vertically upper side of the developer tank. Thus, the inner spiral blade and the outer spiral blade of the first developer conveying member pass through from an upper side to a lower side in the vertical direction with respect to the developer at a position facing the first communicating path. Therefore, the developer which is biased to the communicating path side with repelling due to the above-described two flows of the developer whose directions are different from each other is biased also to the vertically lower side due to friction with the inner spiral blade and the outer spiral blade. Thereby, the developer biased to the communicating path side with the double spiral blade of the first developer conveying member is suppressed from going back to the first conveyance path in which the first developer conveying member is provided, and it is thus possible circulate and convey the developer more smoothly.

Further, it is preferable that the outer spiral blade is formed of an elastic sponge.

Further, the outer spiral blade is formed of an elastic sponge, so that a load applied to the developer due to repelling of the above-described two flows of the developer whose directions are different from each other can be suppressed.

Further, the technology provides an electrophotographic image forming apparatus comprising the developing device described above.

By providing the above-described developing device, the load applied to the developer is suppressed. Thereby, the image forming apparatus can suppress deterioration of an image quality.

BRIEF DESCRIPTION OF THE DRAWINGS

Other and further objects, features, and advantages of the technology will be more explicit from the following detailed description taken with reference to the drawings wherein.

DETAILED DESCRIPTION

Figure 1:
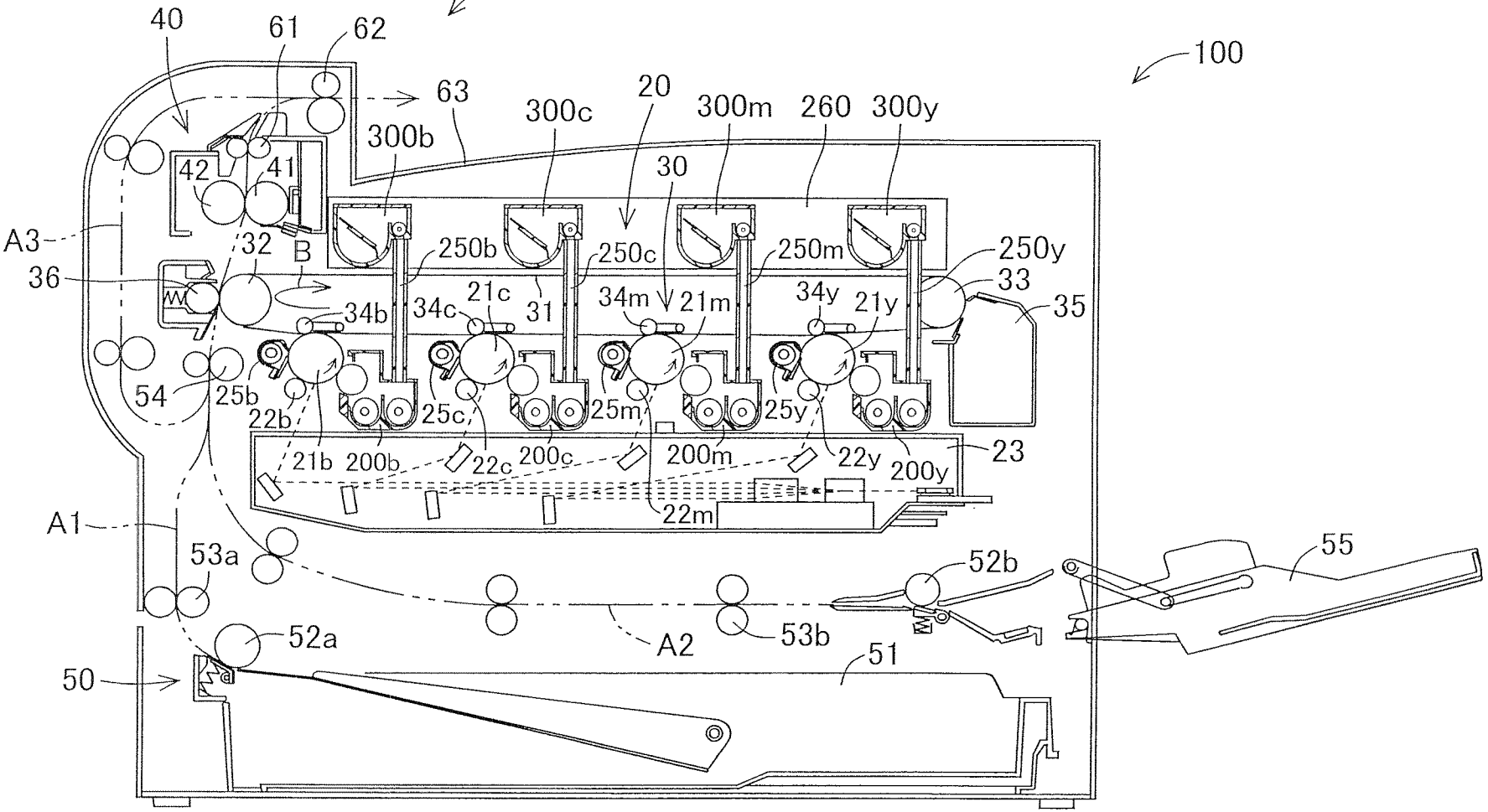
FIG. 1 is a schematic diagram showing a configuration of an image forming apparatus.

Now referring to the drawings, preferred embodiments are described below.

First, an image forming apparatus 100 having a developing device 200 according to a first embodiment will be described. FIG. 1 is a schematic diagram showing a configuration of the image forming apparatus 100. The image forming apparatus 100 is a multi-functional peripheral which has a copier function, a printer function, and a facsimile function. A full-color or monochrome image is formed on a recording medium in accordance with the image information transmitted to the image forming apparatus 100. The image forming apparatus 100 has three print modes, that is, a copier mode (copying mode), a printer mode, and a facsimile mode. The print mode is selected by a control unit section (not shown) in accordance with the operation input from an operation portion (not shown) and reception of a print job from a personal computer, a mobile terminal device, an information recording medium, or an external device using a memory device.

The image forming apparatus 100 includes a toner image forming section 20, a transfer section 30, a fixing section 40, a recording medium feeding section 50, a discharging section 60, and a control unit section (not shown). The toner image forming section 20 includes photoreceptor drums 21*b*, 21*c*, 21*m*, and 21*y*, charging sections 22*b*, 22*c*, 22*m*, and 22*y*, an exposure unit 23, developing devices 200*b*, 200*c*, 200*m*, and 200*y*, cleaning units 25*b*, 25*c*, 25*m*, and 25*y*, and toner cartridges 300*b*, 300*c*, 300*m*, and 300*y*, and the toner supply pipes 250*b*, 250*c*, 250*m*, and 250*y*. The transfer section 30 includes an intermediate transfer belt 31, a driving roller 32, a driven roller 33, intermediate transfer rollers 34*b*, 34*c*, 34*m*, and 34*y*, a transfer belt cleaning unit 35, and a transfer roller 36.

The photoreceptor drum 21, the charging section 22, the developing device 200, the cleaning unit 25, the toner cartridge 300, the toner supply pipe 250 and the intermediate transfer roller 34 are provided in four sets so as to correspond to the image information of the respective colors of black (b), cyan (c), magenta (m), and yellow (y) which are included in the color image information. In this specification, when the four sets of respective components provided for the respective colors are distinguished, letters indicating the respective colors are affixed to the end of the numbers representing the respective components, and combinations of the numbers and alphabets are used as the reference numerals. When the respective components are collectively referred, only the numerals representing the respective components are used as the reference numerals.

The photoreceptor drum 21 is supported so as to be rotatable around an axial line thereof by a driving section (not shown) and includes a conductive substrate (not shown) and a photoconductive layer (not shown) formed on the surface of the conductive substrate. The conductive substrate can be formed in various shapes such as a cylindrical shape, a circular columnar shape, and a thin-film sheet shape. The photoconductive layer formed of a material which exhibits conductive properties upon irradiation of light. As for the photoreceptor drum 21, a structure which includes a cylindrical member (conductive substrate) formed of aluminum and a thin film (photoconductive layer) formed on the outer circumferential surface of the cylindrical member and formed of amorphous silicon (a-Si), selenium (Se), or an organic photoconductor (CPC) can be used, for example.

The charging section 22, the developing device 200, and the cleaning unit 25 are disposed around the photoreceptor drum 21 in that order in a rotation direction thereof. The charging section 22 is disposed vertically below the developing device 200 and the cleaning unit 25.

The charging section 22 is a device that charges a surface of the photoreceptor drum 21 so as to have predetermined polarity and potential. The charging section 22 is provided along a longitudinal direction of the photoreceptor drum 21 so as to face the photoreceptor drum 21. In the case of a contact charging type, the charging section 22 is provided in contact with the surface of the photoreceptor drum 21. In the case of a non-contact charging type, the charging section 22 is provided so as to be separated from the surface of the photoreceptor drum 21.

The charging section 22 is provided around the photoreceptor drum 21 together with the developing device 200, the cleaning unit 25, and the like. The charging section 22 is preferably provided at a position closer to the photoreceptor drum 21 than the developing device 200, the cleaning unit 25, and the like. In this way, it is possible to securely prevent the occurrence of charging faults of the photoreceptor drum 21.

As for the charging section 22, a brush-type charger, a roller-type charger, a corona discharger, an ion-generating device, or the like can be used. The brush-type charger and the roller-type charger are a charging device of contact charging type. The brush-type charger includes one which uses a charging brush, one which uses a magnetic brush, and one which uses other brushes. The corona discharger and the ion-generating device are a charging device of non-contact charging type. The corona discharger includes one which uses a wire-shaped discharge electrode, one which uses a pin-array discharge electrode, one which uses a needle-shaped discharge electrode, and one which uses other discharge electrodes.

The exposure unit 23 is disposed so that light emitted from the exposure unit 23 passes between the charging section 22 and the developing device 200 and reaches the surface of the photoreceptor drum 21. In the exposure unit 23, the charged surfaces of the photoreceptor drums 21*b*, 21*c*, 21*m*, and 21*y* are irradiated with laser beams corresponding to image information of the respective colors, whereby electrostatic latent images corresponding to the image information of the respective colors are formed on the respective surfaces of the photoreceptor drums 21*b*, 21*c*, 21*m*, and 21*y*. As for the exposure unit 23, a laser scanning unit (LSU) having a laser-emitting portion and a plurality of reflecting mirrors can be used, for example. As for the exposure unit 23, an LED (Light Emitting Diode) array and a unit in which a liquid-crystal shutter and a light source are appropriately combined may be used.

The developing device 200 is a device that develops an electrostatic latent image formed on the photoreceptor drum 21 with a toner so as to form a toner image on the photoreceptor drum 21. To a vertically upper part of the developing device 200, the toner supply pipe 250 which is a tubular member is connected. Description for the developing device 200 will be given in detail below.

The toner cartridge 300 is arranged vertically above the developing device 200 and stores an unused toner. To a vertically lower part of the toner cartridge 300, the toner supply pipe 250 is connected. The toner cartridge 300 supplies a toner to the developing device 200 through the toner supply pipe 250. Description for the toner cartridge 300 will be given in detail below.

The cleaning unit 25 is a member which removes the toner which remains on the surface of the photoreceptor drum 21 after the toner image has been transferred from the photoreceptor drum 21 to the intermediate transfer belt 31, and thus cleans the surface of the photoreceptor drum 21. As for the cleaning unit 25, a plate-shaped member for scraping toner and a container-like member for collecting the scraped toner are used, for example.

According to the toner image forming section 20, the surface of the photoreceptor drum 21 which is evenly charged by the charging section 22 is irradiated with laser beams corresponding to the image information from the exposure unit 23, whereby electrostatic latent images are formed on the surface of the photoreceptor drum 21. The toner is supplied from the developing device 200 to the electrostatic latent images on the photoreceptor drum 21, whereby toner images are formed. The toner images are transferred to the intermediate transfer belt 31 described later. The toner which remains on the surface of the photoreceptor drum 21 after the toner images has been transferred to the intermediate transfer belt 31 is removed by the cleaning unit 25.

The intermediate transfer belt 31 is an endless belt-shaped member which is disposed vertically above the photoreceptor drum 21. The intermediate transfer belt 31 is supported around the driving roller 32 and the driven roller 33 with tension to form a loop-shaped path and is turned to run in the direction indicated by an arrow B.

The driving roller 32 is provided so as to be rotatable around an axial line thereof by a driving section (not shown). The intermediate transfer belt 31 is caused to turn by rotation of the driving roller 32 in the direction indicated by the arrow B. The driven roller 33 is provided so as to be rotatable in accordance with rotation of the driving roller 32 and generates a constant tension in the intermediate transfer belt 31 so that the intermediate transfer belt 31 does not go slack.

The intermediate transfer roller 34 is provided so as to come into pressure-contact with the photoreceptor drum 21 with the intermediate transfer belt 31 interposed therebetween and be rotatable around an axial line thereof by a driving section (not shown). As for the intermediate transfer roller 34, one in which a conductive elastic member is formed on the surface of a roller made of metal (for example, stainless steel) having a diameter of 8 mm to 10 mm can be used, for example. The intermediate transfer roller 34 is connected to a power source (not shown) that applies a transfer bias voltage and has a function of transferring the toner images on the surface of the photoreceptor drum 21 to the intermediate transfer belt 31.

The transfer roller 36 is provided so as to come into pressure-contact with the driving roller 32 with the intermediate transfer belt 31 interposed therebetween and be rotatable around an axial line thereof by a driving section (not shown). In a pressure-contact portion (a transfer nip region) between the transfer roller 36 and the driving roller 32, the toner images which have been borne on the intermediate transfer belt 31 and conveyed to the pressure-contact portion are transferred to recording medium fed from the recording medium feeding section 50 described later.

The transfer belt cleaning unit 35 is provided so as to face the driven roller 33 with the intermediate transfer belt 31 interposed therebetween and come into contact with a toner image bearing surface of the intermediate transfer belt 31. The transfer belt cleaning unit 35 is provided so as to remove and collect the toner which remains on the surface of the intermediate transfer belt 31 after the toner images have been transferred to the recording medium. When the toner remains adhering to the intermediate transfer belt 31 after the toner images have been transferred to the recording medium, there is a possibility that the residual toner adheres to the transfer roller 36 due to turning of the intermediate transfer belt 31. When the toner adheres to the transfer roller 36, the toner may contaminate the rear surface of a recording medium which is subsequently subjected to transfer.

According to the transfer section 30, when the intermediate transfer belt 31 is turned to run while making contact with the photoreceptor drum 21, a transfer bias voltage having a polarity opposite to the polarity of the charged toner on the surface of the photoreceptor drum 21 is applied to the intermediate transfer roller 34, and the toner images formed on the surface of the photoreceptor drum 21 are transferred to the intermediate transfer belt 31. The toner images of the respective colors formed by the respective photoreceptor drums 21*y*, 21*m*, 21*c*, and 21*b* are sequentially transferred and overlaid onto the intermediate transfer belt 31, whereby full-color toner images are formed. The toner images transferred to the intermediate transfer belt 31 are conveyed to the transfer nip region by turning movement of the intermediate transfer belt 31, and the toner images are transferred to the recording medium in the transfer nip region. The recording medium on which the toner images are transferred is conveyed to a fixing section 40 described later.

The recording medium feeding section 50 includes a paper feed box 51, pickup rollers 52*a* and 52*b*, conveying rollers 53*a* and 53*b*, registration rollers 54, and a paper feed tray 55. The paper feed box 51 is a container-shaped member which is disposed in a vertically lower part of the image forming apparatus 100 so as to store recording mediums at the inside of the image forming apparatus 100. The paper feed tray 55 is a tray-shaped member which is provided on an outer wall surface of the image forming apparatus 100 so as to store recording mediums outside the image forming apparatus 100. Examples of the recording medium include plain paper, color copy paper, overhead projector sheets, and postcards.

The pickup roller 52*a* is a member which takes out the recording mediums stored in the paper feed box 51 sheet by sheet and feeds the recording medium to a paper conveyance path A1. The conveying rollers 53*a* are a pair of roller-shaped members disposed so as to come into pressure-contact with each other, and convey the recording medium towards the registration rollers 54 along the paper conveyance path A1. The pickup roller 52*b* is a member which takes out the recording mediums stored in the paper feed tray 55 sheet by sheet and feeds the recording medium to a paper conveyance path A2. The conveying rollers 53*b* are a pair of roller-shaped members disposed so as to come into pressure-contact with each other, and convey the recording medium towards the registration roller 54 along the paper conveyance path A2.

The registration rollers 54 are a pair of roller-shaped members disposed so as to come into pressure-contact with each other, and feed the recording medium fed from the conveying rollers 53*a* and 53*b* to the transfer nip region in synchronization with the conveyance of the toner images borne on the intermediate transfer belt 31 to the transfer nip region.

According to the recording medium feeding section 50, the recording medium is fed from the paper feed box 51 or the paper feed tray 55 to the transfer nip region in synchronization with the conveyance of the toner images borne on the intermediate transfer belt 31 to the transfer nip region, and the toner images are transferred to the recording medium.

The fixing section 40 includes a heating roller 41 and a pressure roller 42. The heating roller 41 is controlled so as to maintain a predetermined fixing temperature. The pressure roller 42 is a roller that comes into pressure-contact with the heating roller 41. The heating roller 41 and the pressure roller 42 pinch the recording medium under application of heat, thus fusing the toner of the toner images so as to be fixed to the recording medium. The recording medium to which the toner images have been fixed is conveyed to the discharging section 60 described later.

The discharging section 60 includes conveying rollers 61, discharge rollers 62, and a catch tray 63. The conveying rollers 61 are a pair of roller-shaped members which is disposed vertically above the fixing section 40 so as to come into pressure-contact with each other. The conveying rollers 61 convey the recording medium on which images have been fixed towards the discharge rollers 62.

The discharge rollers 62 are a pair of roller-shaped members which is disposed so as to come into contact with each other. In the case of single-side printing, the discharge rollers 62 discharge a recording medium on which single-side printing has finished to the catch tray 63. In the case of double-side printing, the discharge rollers 62 convey a recording medium on which single-side printing has finished to the registration rollers 54 along the paper conveyance path A3 and then discharges a recording medium on which double-side printing has finished to the discharge tray 63. The catch tray 63 is provided on the vertically upper surface of the image forming apparatus 100 so as to store recording mediums to which images have been fixed.

The image forming apparatus 100 includes the control unit section (not shown). The control unit section is provided in the vertically upper part of the internal space of the image forming apparatus 100 and includes a memory portion, a computing portion, and a control portion. To the memory portion, various setting values mediated through an operation panel (not shown) disposed on the vertically upper surface of the image forming apparatus 100, the results detected by sensors (not shown) disposed in various portions inside the image forming apparatus 100, image information from an external device and the like are inputted. Moreover, programs for executing various processes are written in the memory portion. Examples of the various processes include a recording medium determination process, an attachment amount control process, and a fixing condition control process.

As for the memory portion, memories customarily used in this technical field can be used, and examples thereof include a read-only memory (ROM), a random-access memory (RAM), and a hard disc drive (HDD). As for the external device, electrical and electronic devices which can form or obtain the image information and which can be electrically connected to the image forming apparatus 100 can be used. Examples thereof include computers, digital cameras, televisions, video recorders, DVD (Digital Versatile Disc) recorders, HD-DVD (High-Definition Digital Versatile Disc) recorders, Blu-ray disc recorders, facsimile machines, and mobile terminal devices.

The computing portion takes out various kinds of data (for example, image formation commands, detection results, and image information) written in the memory portion and the programs for various processes and then makes various determinations. The control portion sends a control signal to the respective devices provided in the image forming apparatus 100 in accordance with the determination result by the computing portion, thus performing control on operations.

The control portion and the computing portion include a processing circuit which is realized by a microcomputer, a microprocessor, and the like having a central processing unit (CPU). The control unit section includes a main power source as well as the processing circuit. The power source supplies electricity to not only the control unit section but also to respective devices provided in the image forming apparatus 100.

Figure 2:
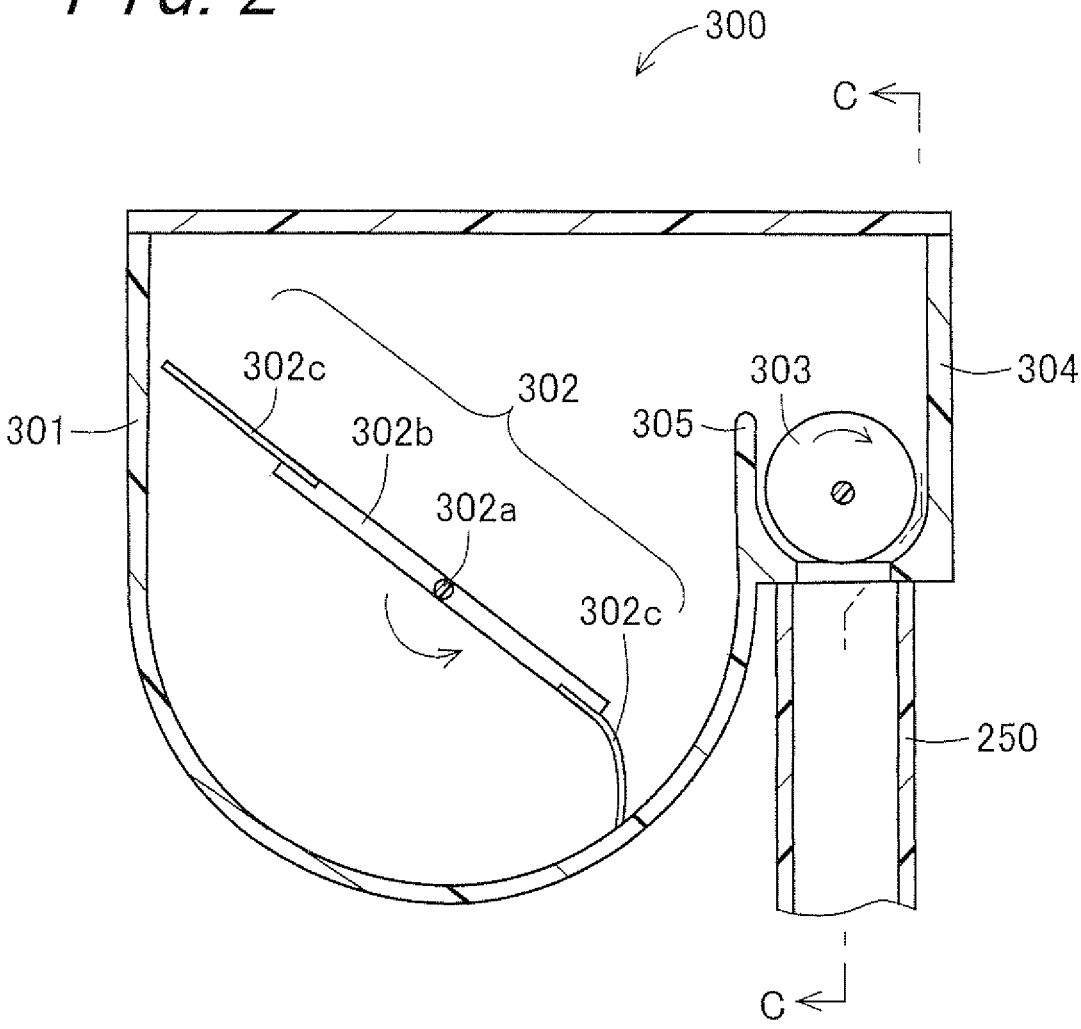
FIG. 2 is a schematic view showing a configuration of a toner cartridge.
Figure 3:
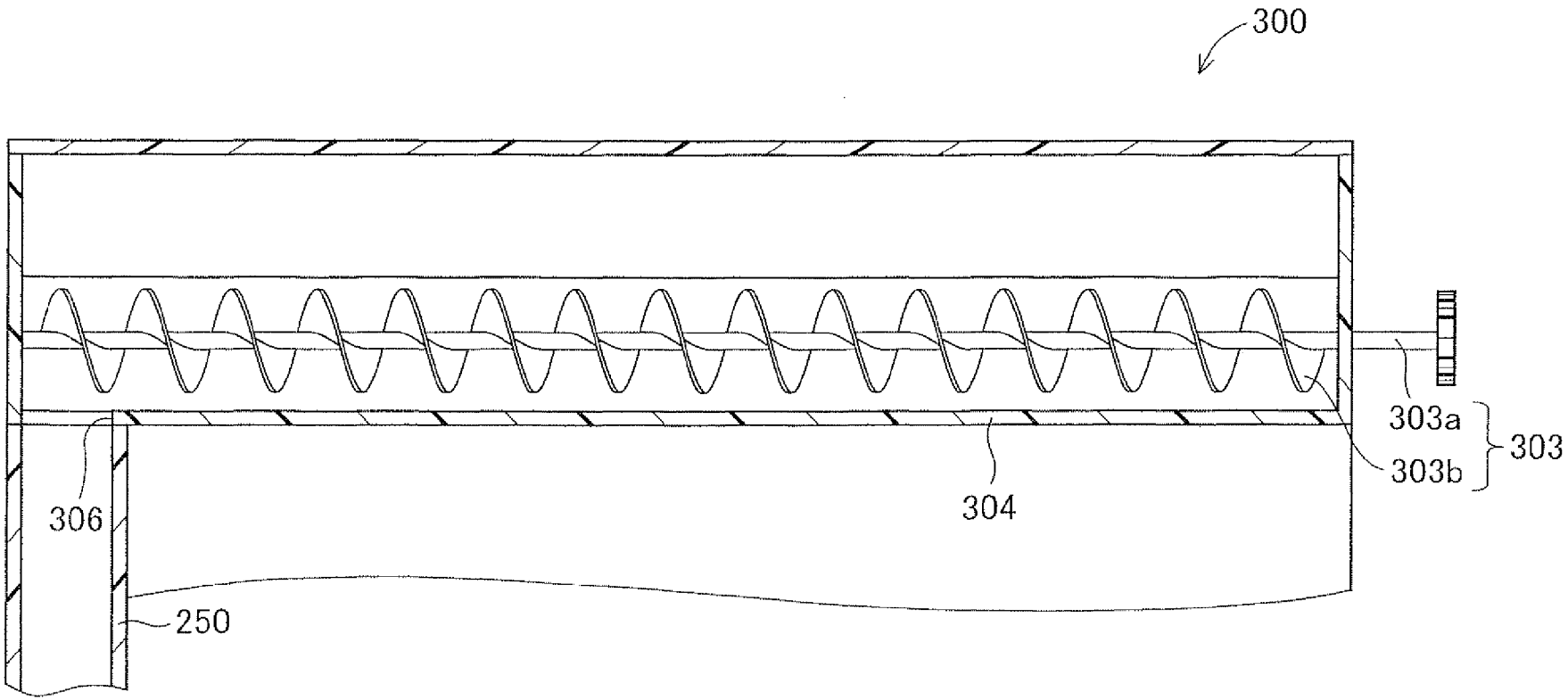
FIG. 3 is a sectional view of the toner cartridge taken along the line C-C of FIG. 2.

FIG. 2 is a schematic view showing a configuration of the toner cartridge 300. FIG. 3 is a sectional view of the toner cartridge 300 taken along the line C-C of FIG. 2. The toner cartridge 300 is a device that supplies a toner to the developing device 200 through the toner supply pipe 250. The toner cartridge 300 includes a toner container 301, a toner scooping member 302, a toner discharge member 303 and a toner discharge container 304.

The toner container 301 is a container-like member having an approximately semicircular columnar internal space, and in the internal space, supports the toner scooping member 302 so as to freely rotate and contains an unused toner. The toner discharge container 304 is a container-like member having an approximately semicircular columnar internal space provided along a longitudinal direction of the toner container 301, and in the internal space, supports the toner discharge member 303 so as to freely rotate. The internal space of the toner container 301 and the internal space of the toner discharge container 304 communicate with each other through a communicating opening 305 formed along the longitudinal direction of the toner container 301. The toner discharge container 304 has a discharge port 306 formed on a vertically lower part thereof. To the discharge port 306 of the toner discharge container 304, the toner supply pipe 250 is connected.

The toner scooping member 302 includes a rotation shaft 302*a*, a base member 302*b* and a sliding section 302*c*. The rotation shaft 302*a* is a column-shaped member extending along a longitudinal direction of the toner container 301. The base member 302*b* is a plate-like member extending along the longitudinal direction of the toner container 301, and attached to the rotation shaft 302*a* at a center in a width direction and a thickness direction thereof. The sliding section 302*c* is a member having flexibility and attached to both end parts in the width direction of the base member 302*b*, and is formed of, for example, a polyethylene terephthalate (PET). The toner scooping member 302 scoops the toner inside the toner container 301 into the toner discharge container 304 by which the base member 302*b* performs rotation motion following rotation of the rotation shaft 302*a* around the axial line thereof, whereby the sliding section 302*c* provided at the both end parts in the width direction of the base member 302*b* slides on an inner wall face of the toner container 301.

The toner discharge member 303 is a member that conveys the toner inside the toner discharge container 304 toward the discharge port 306. The toner discharge member 303 is a so-called auger screw including a toner discharge rotation shaft 303*a*, and a toner discharge blade 303*b* provided around the toner discharge rotation shaft 303*a*.

According to the toner cartridge 300, an unused toner in the toner container 301 is scooped into the toner discharge container 304 by the toner scooping member 302. Then, the toner scooped by the toner discharge container 304 is conveyed to the discharge port 306 by the toner discharge member 303. The toner conveyed to the discharge port 306 is discharged from the discharge port 306 to the outside of the toner discharge container 304, and supplied to the developing device 200 through the toner supply pipe 250.

Figure 4:
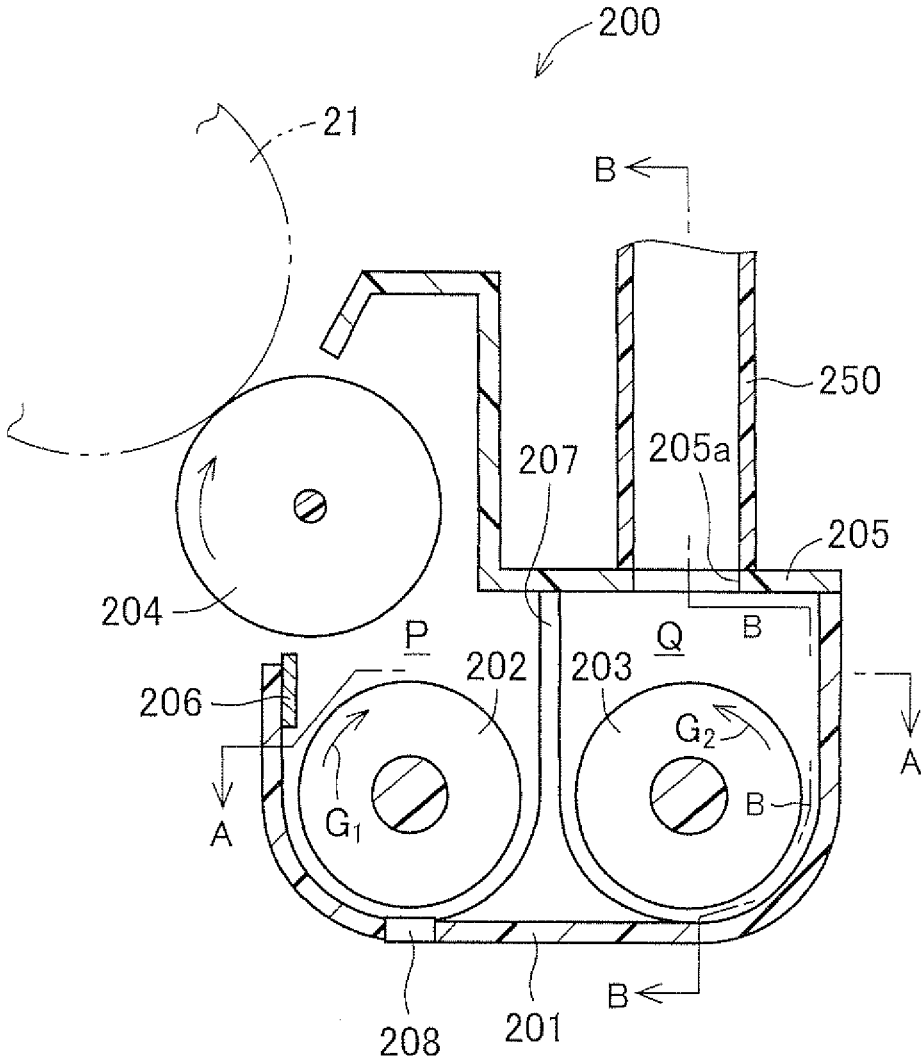
FIG. 4 is a schematic view showing a configuration of a developing device.
Figure 5:
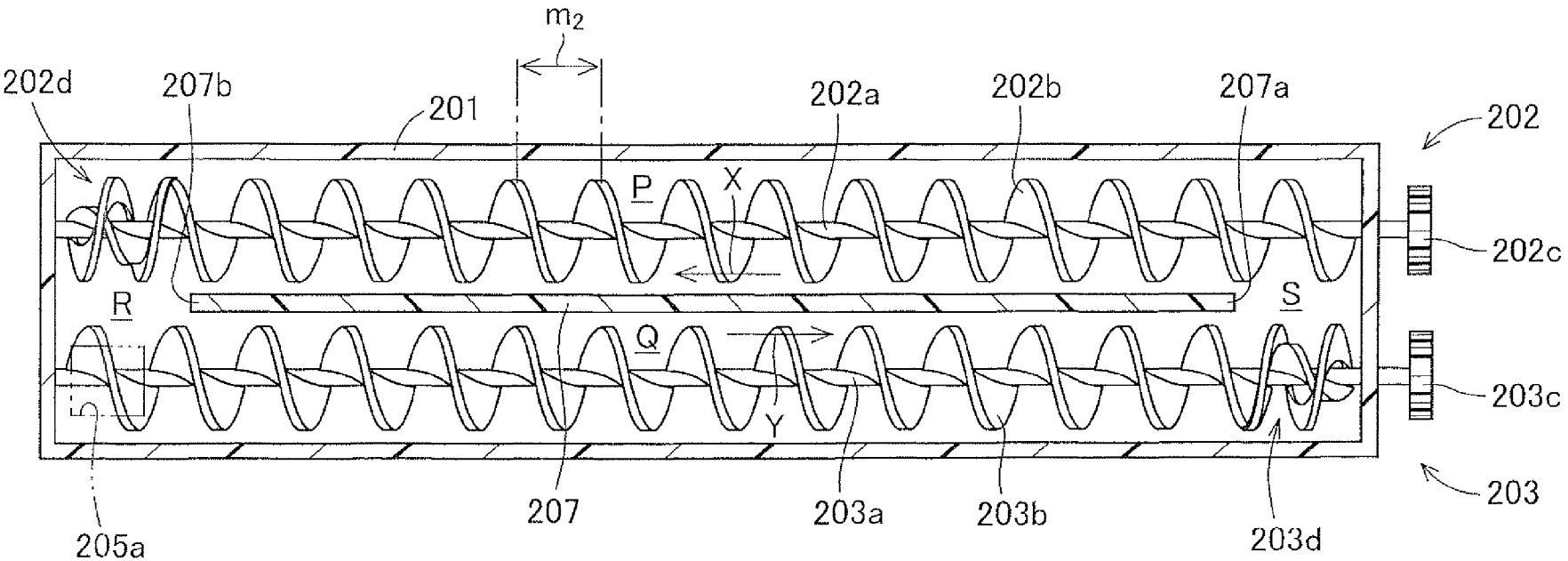
FIG. 5 is a sectional view of the developing device taken along the line A-A of FIG. 4.
Figure 6:
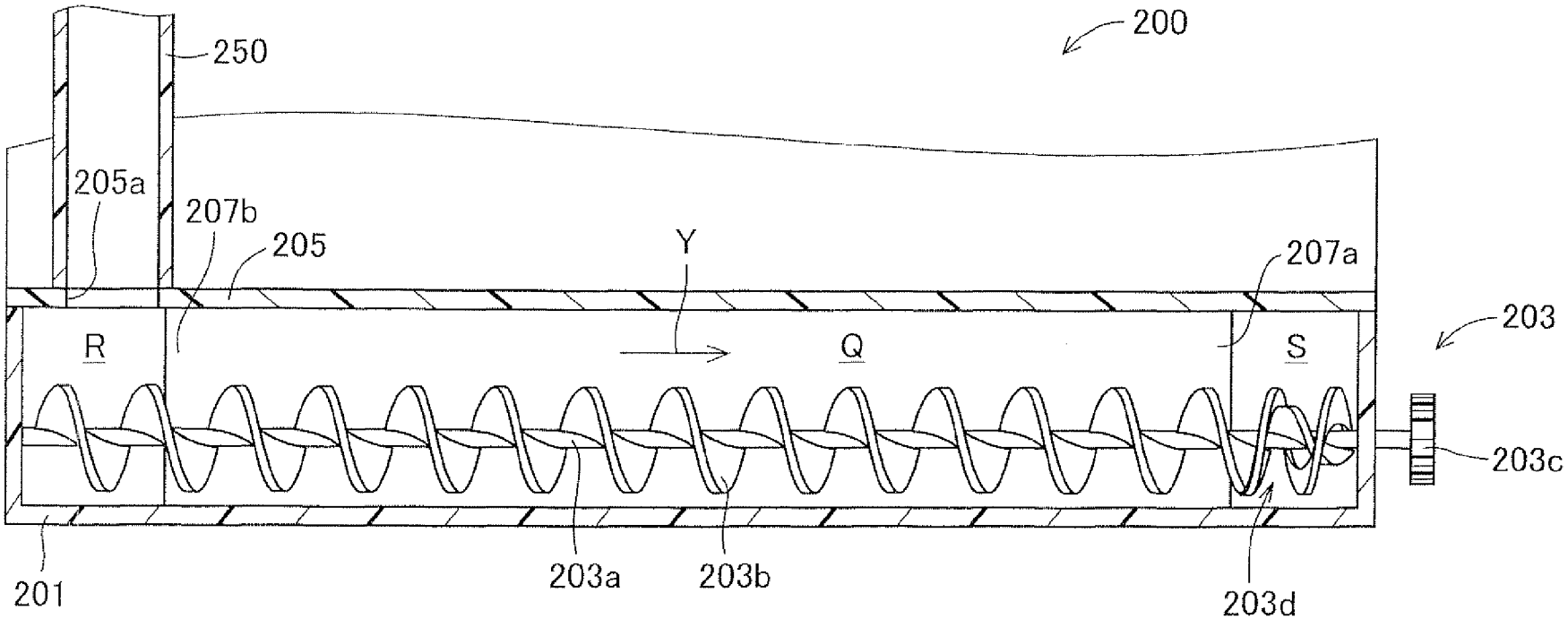
FIG. 6 is a sectional view of the developing device taken along the line B-B of FIG. 4.

FIG. 4 is a schematic view showing a configuration of the developing device 200. FIG. 5 is a sectional view of the developing device 200 taken along the line A-A of FIG. 4. FIG. 6 is a sectional view of the developing device 200 taken along the line B-B of FIG. 4. The developing device 200 is a device which supplies a toner onto a surface of the photoreceptor drum 21 so as to develop an electrostatic latent image formed on the surface thereof. The developing device 200 includes a developer tank 201, a first developer conveying member 202, a second developer conveying member 203, a developing roller 204, a developer tank cover 205, a doctor blade 206, a partition 207 and a toner concentration detection sensor 208.

The developer tank 201 is an elongated member having an internal space, and stores a developer in the internal space. The developer used in this embodiment may be a one-component developer composed only of a toner, or may be a two-component developer containing a toner and a carrier. In the developer tank 201, there are provided the developer tank cover 205 is provided on a vertically upper part thereof, and in the internal space, the first developer conveying member 202, the second developer conveying member 203, the developing roller 204, the doctor blade 206, the partition 207 and the toner concentration detection sensor 208.

The developing roller 204 is a magnet roller which rotates around an axial line by a driving section (not shown), and bears a developer in the developer tank 201 on a surface thereof and conveys the toner contained in the borne developer to a vicinity of the photoreceptor drum 21. To the developing roller 204, a power source (not shown) is connected and a developing bias voltage is applied. The toner borne on the developing roller 204 is, in the vicinity of the photoreceptor drum 21, moved to the photoreceptor drum 21 with an electrostatic force by the developing bias voltage.

The doctor blade 206 is a plate-like member extending in an axial line direction of the developing roller 204, and is provided so that one end in a width direction thereof is fixed to the developer tank 201, and another end thereof has a clearance with respect to the surface of the developing roller 204. The doctor blade 206 is provided so as to have a clearance with respect to the surface of the developing roller 204, and an amount of developer borne on the developing roller 204 is thereby regulated to a predetermined amount. As a material of the doctor blade 206, stainless steel, aluminum, a synthetic resin, or the like is usable.

The partition 207 is a member in a longitudinal shape extending along a longitudinal direction of the developer tank 201. The partition 207 is provided between a vertically lower part of the developer tank 201 and the developer tank cover 205, and provided so that both end parts in the longitudinal direction separate from an inner wall face of the developer tank 201. The partition 207 partitions the internal space of the developer tank 201 into a first conveyance path P, a second conveyance path Q, a first communicating path R, and a second communicating path S.

The first conveyance path P is a space extending along a longitudinal direction of the partition 207 and containing the developing roller 204. The second conveyance path Q is a space lying opposite to the first conveyance path P with the partition 207 interposed therebetween. The first communicating path R is a space communicating with the first conveyance path P and the second conveyance path Q at another end 207*b* in the longitudinal direction of the partition 207. The second communicating path S is a space communicating with the first conveyance path P and the second conveyance path Q at one end 207*a* in the longitudinal direction of the partition 207. A distance between each of the ends 207*a* and 207*b* in the longitudinal direction of the partition 207 and the inner wail of the developer tank 201 which define the first communicating path R and the second communicating path S is, for example, 25 mm to 40 mm.

The developer tank cover 205 is detachably provided on a vertically upper side of the developer tank 201. In the developer tank cover 205, a supply port 205*a* is formed. The supply port 205*a* is formed at a position facing the first communicating path R vertically above the second conveyance path Q. To the developer tank cover 205, at the supply port 205*a*, the toner supply pipe 250 is connected. The toner contained in the toner cartridge 300 is supplied into the developer tank 201 through the toner supply pipe 250 and the supply port 205*a*.

The first developer conveying member 202 is provided in the first conveyance path P, and includes a first rotation shaft 202*a*, a first conveying blade 202*b*, and a first conveying gear 202*c*. The first rotation shaft 202*a* is a column-shaped member extending in the longitudinal direction of the partition 207. The first rotation shaft 202*a* rotates in a rotation direction $G_1$ around an axial line thereof through the first conveying gear 202*c* by a driving section such as a motor. The first conveying blade 202*b* is provided around the first rotation shaft 202*a*. The first developer conveying member 202 conveys the developer stored in the first conveyance path P of the developer tank 201 in a first developer conveying direction X with rotation motion of the first conveying blade 202*b* following rotation of the first rotation shaft 202*a*. The first developer conveying direction X is a direction going from a side of the end 207*a* in the longitudinal direction of the partition 207 to a side of the other end 207*b* in the longitudinal direction along the axial line of the first rotation shaft 202*a*.

The second developer conveying member 203 is provided in the second conveyance path Q, and includes a second rotation shaft 203*a*, a second conveying blade 203*b*, and a second conveying gear 203*c*. The second rotation shaft 203*a* is a column-shaped member extending in the longitudinal direction of the partition 207. The second rotation shaft 203*a* rotates in a rotation direction $G_2$ around an axial line through the second conveying gear 203*c* by a driving section such as a motor. The second conveying blade 203*b* is provided around the second rotation shaft 203*a*. The second developer conveying member 203 conveys the developer stored in the second conveyance path Q of the developer tank 201 in a second developer conveying direction Y with rotation motion of the second conveying blade 203*b* following rotation of the second rotation shaft 203*a*. The second developer conveying direction Y is a direction going from the side of the other end 207*b* in the longitudinal direction of the partition 207 to the side of the one end 207*a* in the longitudinal direction along an axial line of the second rotation shaft 203*a*. That is, the second developer conveying direction Y is opposite to the first developer conveying direction X.

As described above, the supply port 205*a* of the developer tank cover 205 is formed at a position facing the second communicating path R vertically above the second communicating path Q. Therefore, an unused toner in the toner cartridge 300 is supplied to an upstream side in the second developer conveying direction Y in the second conveyance path Q, first of all, and thereafter, conveyed to a downstream side in the second developer conveying direction Y by the second developer conveying member 203.

In this embodiment, the first developer conveying member 202 has a double spiral blade 202*d* on a downstream side in the first developer conveying direction X from the first conveying blade 202*b*, and the second developer conveying member 203 has a double spiral blade 203*d* on a downstream side in the second developer conveying direction Y from the second conveying blade 203*b*.

In this embodiment, the first developer conveying member 202 and the second developer conveying member 203 are configured to have the same shape. However, the first developer conveying member 202 and the second developer conveying member 203 may not have the same shape, and for example, may respectively have double spiral blades whose shapes are different from each other, or may be provided with a double spiral blade only for either first developer conveying member 202 or the second developer conveying member 203. Description will be given in detail below for the first developer conveying member 202 and the second developer conveying member 203.

The toner concentration detection sensor 208 is attached to a vertically lower part of the developer tank 201 vertically below the first developer conveying member 202, and is provided so that a sensor face thereof is exposed to the first conveyance path P. The toner concentration detection sensor 208 is electrically connected to a toner concentration control section (not shown).

The toner concentration control section performs control to rotate the toner discharge member 303 and supply a toner into the developer tank 201 in accordance with a toner concentration detection result detected by the toner concentration sensor 208. More specifically, the toner concentration control section judges whether or not a toner concentration detection result from the toner concentration detection sensor 208 is lower than a predetermined set value, and in the case of judging as low, sends a control signal to a driving section for rotating the toner discharge member 303 so as to rotate the toner discharge member 303 for a predetermined period.

Moreover, to the toner concentration detection sensor 208, a power source (not shown) is connected. The power source applies a driving voltage for driving the toner concentration detection sensor 208 and a control voltage for outputting the toner concentration detection result to the toner concentration control section, to the toner concentration detection sensor 208. The application of the voltage to the toner concentration detection sensor 208 by the power source is controlled by the control portion (not shown).

As the toner concentration detection sensor 208, a general toner concentration detection sensor can be used, and examples thereof include a transmission light detection sensor, a reflection light detection sensor, and a permittivity detection sensor. Among these sensors, a permittivity detection sensor is preferred. Examples of the permeability detection sensor includes TS-L (trade name, manufactured by TDK Corporation), TS-A (trade name, manufactured by TDK Corporation), and TS-K (trade name, manufactured by TDK Corporation).

According to such a developing device 200, in the developer tank 201, the developer is circulated and conveyed through the second conveyance path Q, the second communicating path S, the first conveyance path P, and the first communicating path R, in this order. That is, in this embodiment, a direction of a flow of the developer stored in the developer tank 201 in the case of being viewed from a vertically upper side of the developer tank 201 is a left-handed direction. A part of the developer circulated and conveyed in this manner is borne on a surface of the developing roller 204 in the first conveyance path P, and a toner in the borne developer is moved to the photoreceptor drum 21 and consumed sequentially. When the toner concentration detection sensor 208 detects that a predetermined amount of the toner is consumed, an unused toner is supplied from the toner cartridge 300 to the second conveyance path Q. The supplied toner is, while being circulated and conveyed in the second conveyance path Q, dispersed into the developer.

Hereinafter, description will be given in detail for the first developer conveying member 202. Note that, since the second developer conveying member 203 has the same shape as the first developer conveying member 202, which description is thus omitted. As described above, the first developer conveying member 202 includes the first rotation shaft 202*a*, the first conveying blade 202*b*, the first conveying gear 202*c*, and the double spiral blade 202*d*. The first rotation shaft 202*a*, the first conveying blade 202*b* and the first conveying gear 202*c* are formed of a material such as, for example, polyethylene, polypropylene, high-impact polystyrene and an ABS resin (acrylonitrile-butadiene-styrene copolymer synthetic resin). The first rotation shaft 202*a* is a column-shaped member and an external diameter thereof can be appropriately set within the range of 2 mm to 10 mm. The first rotation shaft 202*a* rotates in the rotation direction $G_1$ at 200 rpm to 500 rpm by a driving section (not shown).

The first conveying blade 202*b* performs, following rotation of the first rotation shaft 202*a* in the rotation direction $G_1$, rotation motion around an axial line of the first rotation shaft 202*a* so that a developer in the first conveyance path P is moved in the first developer conveying direction X. In this embodiment, the first conveying blade 202*b* is a continuous general spiral blade. In this embodiment, the "general spiral blade" is generally a blade part of a so-called auger screw, and more specifically, a member with a predetermined thickness having a general spiral blade surface as a main surface. The general spiral blade is provided around the first rotation shaft 202*a* in an inner circumferential portion thereof. Here, the inner circumferential portion of the general spiral blade is a part that is closest to the axial line of the first rotation shaft 202*a* on the above-described general spiral blade surface, and an outer circumferential portion of the general spiral blade is a part that is farthest from the first rotation shaft 202*a* on the above-described general spiral blade surface. A shape of the general spiral blade surface is a shape so that the inner circumferential portion and the outer circumferential portion are imaginary general spirals that are different from each other, and the details will be described below.

In this embodiment, a "spiral" is a consecutive space curve on a side surface of an imaginary circular column, and a space curve that advances in one direction among axial line directions of the imaginary circular column while advancing in one direction among circumferential directions of the imaginary circular column. In the case of being viewed on the one direction among the axial line directions of the imaginary circular column, the spiral advancing in a right-handed direction among circumferential directions of the imaginary circular column while advancing in the one direction among the axial line directions of the imaginary circular column is referred to as being a right-handed spiral, whereas a spiral advancing in the left-handed direction while advancing in the one direction among the axial line directions of the imaginary circular column is referred to as being a left-handed spiral. Further, among the spirals, a spiral whose lead angle is constant in all points on the spiral is especially referred to as a "general spiral". Here, an angle formed of a tangent line of the spiral at a certain point on the spiral and a straight line that is made by projecting the tangent line to a vertical plane with respect to the axial line direction of the imaginary circular column surrounded by the spiral is a "lead angle" at the point. The lead angle is an angle that is larger than 0° and smaller than 90°.

An interval of the spiral in the axial line direction of the above-described imaginary circular column is referred to as a "lead". In a one-cyclic or more general spiral, since a lead angle is constant, a lead is also constant. Hereinafter, a lead of the general spiral of an outer circumferential portion of a general spiral blade surface that is a main surface of a general spiral blade is referred to as a lead of the outer circumferential portion of the general spiral blade.

In this embodiment, the "general spiral blade surface" is a surface formed of the trajectory of one line segment $L_1$ outside an imaginary circular column $K_1$ (hereinafter a radius is $r_1$) when the line segment $L_1$ is moved in one direction $D_1$ parallel to the axial line of the imaginary circular column $K_1$ while maintaining a length $m_1$ of the line segment $H_1$ in a radial direction of the imaginary circular column $K_1$ and an attachment angle $\alpha$ of the line segment $L_1$ along one general spiral $C_1$ (hereinafter, a lead angle is constant at $\theta_1$) on a side surface of the imaginary circular column $K_1$. Here, the "attachment angle $\alpha$" is an angle formed by the line segment $H_1$ and a half-line extending in the one direction $D_1$ from a tangent point of the line segment $L_1$ and the imaginary circular column $K_1$ on a plane including the axial line of the imaginary circular column $K_1$ and the line segment $L_1$, and is an angle that is larger than 0° and smaller than 180°.

Figure 7A:
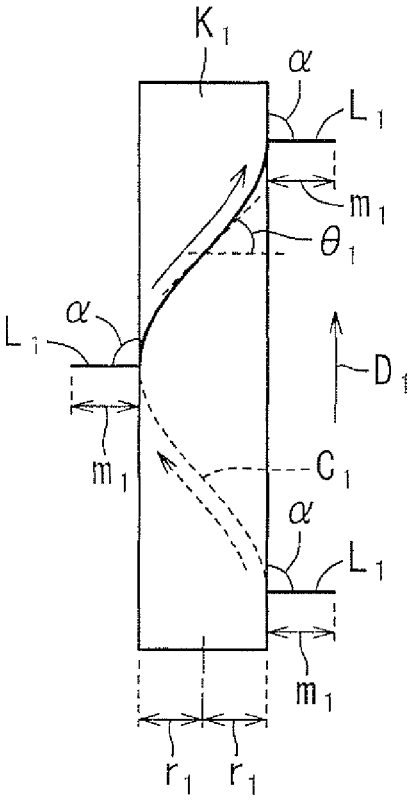
FIGS. 7A and 7B are diagrams illustrating one cyclic general spiral blade surface.
Figure 7B:
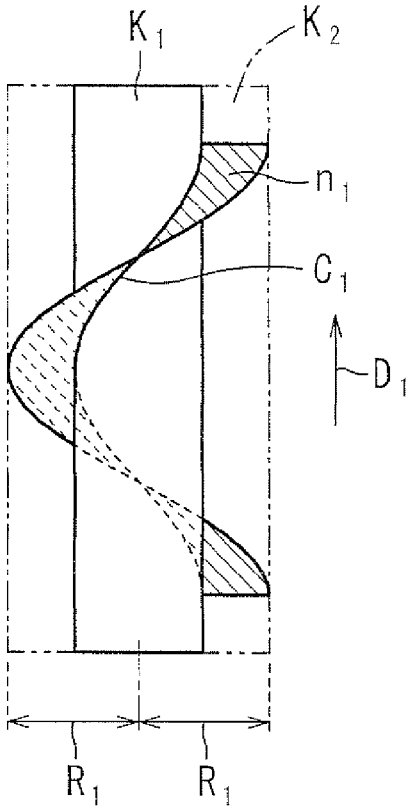

Hereinafter, as an example of the general spiral blade surface, a general spiral blade obtained when a line segment is moved along one cyclic portion of a general spiral ("one cyclic general spiral blade surface"; the same applies to other cycles) is illustrated. FIGS. 7A and 7B are diagrams illustrating one cyclic general spiral blade surface. FIG. 7A shows the side surface of the imaginary circular column $K_1$, the right-handed general spiral $C_1$ on the side surface of the imaginary circular column $K_1$, and the starting and ending positions of the line segment $L_1$ moving in one direction $D_1$ on the general spiral $C_1$. The line segment $L_1$ shown on the lowermost side of the sheet surface of FIG. 7A is the starting position of the moving line segment $L_1$, and the line segment $L_1$ shown on the uppermost side is the ending position. As shown in FIG. 7A, the trajectory of the line segment $L_1$ when the line segment $L_1$ is moved in one direction $D_1$ along the general spiral $C_1$ while constantly maintaining the length $m_1$ in the radial direction of the imaginary circular column $K_1$ and the attachment angle $\alpha$ ($\alpha$=90° in FIG. 7A) of the line segment $L_1$ corresponds to a general spiral blade surface $n_1$ shown in FIG. 7B. The surface depicted by a hatched portion in FIG. 73 is the general spiral blade surface $n_1$.

As shown in FIG. 7B, an outer circumferential portion of the general spiral blade surface $n_1$ becomes a right-handed general spiral that advances in the one direction $D_1$ on a side surface of an imaginary circular column $K_2$ whose axial line is identical with that of the imaginary circular column $K_1$. A radius $R_1$ of the imaginary circular column $K_2$ is equal to the sum of a radius $r_1$ of the imaginary circular column $K_1$ and the length $m_1$ of the line segment $L_1$ in the radial direction of the imaginary circular column $K_1$.

A member with such a general spiral blade surface as a main surface is a general spiral blade. The above-described general spiral blade is, in the case of being used as the first conveying blade 202*b* as in this embodiment, configured so that a diameter $2r_1$ of the imaginary circular column $K_1$ is equal to an external diameter of the first rotation shaft 202*a*. Then, the general spiral blade is provided so that the general spiral blade surface $n_1$ is placed on a side of the first communicating path R in the first developer conveying direction X, and is provided so as to convey a developer in the first developer conveying direction X with the general spiral blade surface $n_1$. Here, in this embodiment, a rotation direction $G_1$ of the first rotation shaft 202*a* is a left-handed direction when being viewed in the first developer conveying direction X. Therefore, in order to convey the developer in the first developer conveying direction X with the general spiral blade surface $n_1$, the general spiral blade needs to be a member with the general spiral blade surface as a main surface that is formed when a line segment is moved along the right-handed general spiral, that is, a right-handed general spiral blade.

Additionally, at the time, a value twice a distance between an inner circumferential portion of the general spiral blade and an axial line of the first rotation shaft 202*a*, that is, an internal diameter of the general spiral blade becomes $2r_1$, and a value twice a distance between an outer circumferential portion of the general spiral blade and the axial line of the first rotation shaft 202*a*, that is, an external diameter of the general spiral blade becomes $2r_1+2m_1$. The length $m_1$ can be appropriately set, for example, within the range of 2 mm to 20 mm. Moreover, for example, the attachment angle $\alpha$ does not need to be 90°, and can be appropriately set within the range of 30° to 150°. The lead angle $\theta_1$ can be appropriately set, for example, within the range of 20° to 70°. Additionally, a lead $m_2$ of the outer circumferential portion of the general spiral blade can be appropriately set, for example, within the range of 20 mm to 50 mm.

In this embodiment, the first conveying blade 202*b* is a general spiral blade having 13 cyclic general spiral blade surfaces, and the thickness of the general spiral blade is uniformly 2 mm. The cycle, the thickness and the like of the general spiral blade can be appropriately set in accordance with a developer conveying speed, the size of the developer tank 201, and the like. For example, the thickness of the general spiral blade used as the first conveying blade 202*b* can be appropriately set within the range of 1.5 mm to 3 mm.

Note that, in this embodiment, although the first conveying blade 202*b* is a continuous general spiral blade, as another embodiment, the first conveying blade 202*b* may be a plurality of general spiral blades that separate from each other at a predetermined interval.

Figure 8:
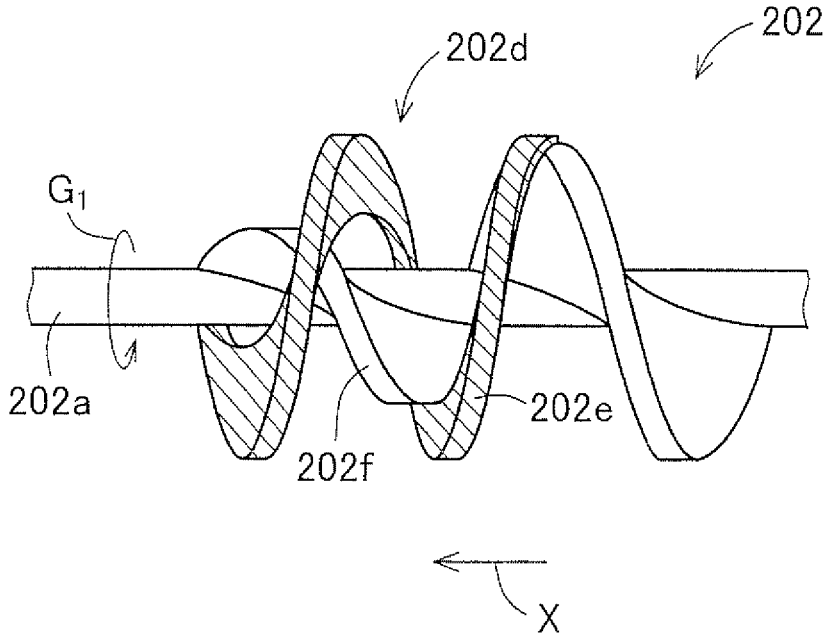
FIG. 8 is a schematic view showing a configuration of a double spiral blade.
Figure 9B:
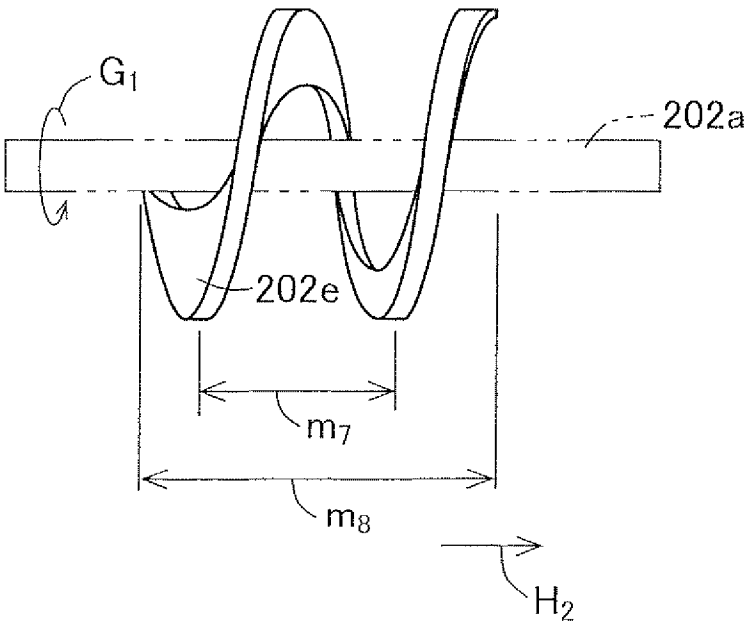
FIG. 9B is a diagram showing an outer spiral blade of the double spiral blade.
Figure 9A:
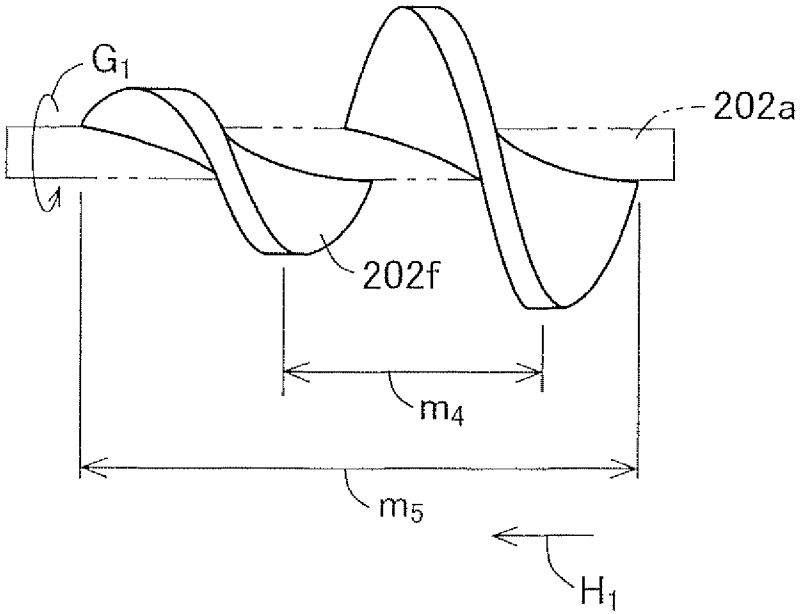
FIG. 9A is a diagram showing an inner spiral blade of the double spiral blade.

Next, description will be given for the double spiral blade 202*d*. FIG. 8 is a schematic view showing a configuration of the double spiral blade 202*d*. The double spiral blade 202*d* includes an outer spiral blade 202*e* depicted by a hatched portion and an inner spiral blade 202*f* in FIG. 8. FIG. 9A is a diagram showing the inner spiral blade 202*f* of the double spiral blade 202*d*, and FIG. 9B is a diagram showing the outer spiral blade 202*e* of the double spiral blade 202*d*. In FIG. 9A, the inner spiral blade 202*f* is depicted by a solid line, and the first rotation shaft 202*a* is depicted by a two-dotted chain line. In FIG. 9B, the outer spiral blade 202*e* is depicted by a solid line, and the first rotation shaft 202*a* is depicted by a two-dotted chain line.

As shown in FIG. 9A, the inner spiral blade 202*f* is provided around the first rotation shaft 202*a*. The inner spiral blade 202*f* performs rotation motion around an axial line of the first rotation shaft 202*a* following rotation of the first rotation shaft 202*a* in the rotation direction $G_1$. With the rotation motion, the inner spiral blade 202*f* conveys a developer which is at a position relatively near to the first rotation shaft 202*a* in a first direction $H_1$ that is the same direction as the first developer conveying direction X. That is, the first developer conveying member 202 in this embodiment is configured so that the first direction $H_1$ that conveys the developer with the inner spiral blade 202*f* is the same direction as the first developer conveying direction X.

As shown in FIG. 9B, the outer spiral blade 202*e* is provided around the inner spiral blade 202*f*. The outer spiral blade 202*e* performs rotation motion around the axial line of the first rotation shaft 202*a* following rotation of the first rotation shaft 202*a* in the rotation direction $G_1$. With the rotation motion, the outer spiral blade 202*e* conveys a developer which is in a position relatively far from the first rotation shaft 202*a* in a second direction $H_2$ that is an opposite direction to the first developer conveying direction X.

When the double spiral blade 202*d* performs rotation motion as described above, a flow of a developer that advances in the first direction $H_1$ and a flow of a developer that advances in the second direction $H_2$ are generated at a position where the inner spiral blade 202*f* and the outer spiral blade 202*e* coexist in an axial line direction of the first rotation shaft 202*a*. Two flows of the developer whose directions are different from each other are thereby generated around a position where the double spiral blade 202*d* is provided in the first rotation shaft 202*a* at the same time. Since the two flows of the developer whose directions are different from each other repel each other, the developer in the position relatively far from the first rotation shaft 202*a* is biased in a direction that separates from the first rotation shaft 202*a*. As a result, it is possible to guide the developer to the first communicating path R without causing an excessive pressure against the developer, and to circulate and convey the developer while suppressing a load applied to the developer. Particularly, in this embodiment, not only the first developer conveying member 202 has the double spiral blade 202*d*, but also the second developer conveying member 203 has the double spiral blade 203*d*, so that the developer on a downstream side in the second developer conveying direction Y in the second conveyance path Q is guided to the second communicating path S with a less load. As a result, it is possible to circulate and convey the developer more smoothly.

Further, in this embodiment, the outer spiral blade 202*e*, which is at a position relatively far from the first rotation shaft 202*a*, conveys a developer in the second direction $H_2$ that is an opposite direction to the first developer conveying direction X. Then the inner spiral blade 202*f*, which is at a position relatively near to the first rotation shaft 202*a*, conveys the developer in the first direction $H_1$ that is the same direction as the first developer conveying direction X, that is, a direction that goes to an inner wall of the developer tank 201. At the time, the developer that is conveyed with the inner spiral blade 202*f* is to go to a vertically lower side, that is, toward the outer spiral blade 202*e*, under its own weight. As a result, it is possible to suppress compression of the developer with the inner wall of the developer tank 201 and the inner spiral blade 202*f* so that a load applied to the developer can be suppressed.

Further, in this embodiment, a direction of a flow of a developer that is stored in the developer tank 201 is a left-handed direction in the case of being viewed from a vertically upper side of the developer tank 201, and the rotation direction $G_1$ of the first rotation shaft 202*a* is also a left-handed direction in the case of being viewed in the first developer conveying direction X. Namely, the first developer conveying member 202 is configured so that the rotation direction $G_1$ of the first rotation shaft 202*a* in the case of being viewed in the first developer conveying direction X coincides with the direction of the flow of the developer in the case of being viewed from the vertically upper side of the developer tank 201. Therefore, the inner spiral blade 202*f* and the outer spiral blade 202*e* of the first developer conveying member 202 come to pass through from an upper side to a lower side in the vertical direction with respect to the developer at a position facing the first communicating path R. Accordingly, the developer to be biased to a side of the first communicating path R with repelling due to the above-described two flows of the developer whose directions are different from each other is biased also to the vertically lower side due to friction with the inner spiral blade 202*f* and the outer spiral blade 202*e*. As a result, the developer biased to the side of the first communicating path R with the double spiral blade 202*d* of the first developer conveying member 202 is prevented from going back to the first conveyance path P, and it is thus possible to circulate and convey the developer more smoothly.

The inner spiral blade 202*f* is formed of materials such as polyethylene, polypropylene, high-impact polystyrene and an ABS resin. In this embodiment, the inner spiral blade 202*f* is a continuous cone-shaped general spiral blade. The cone-shaped general spiral blade is provided around the first rotation shaft 202*a* in an inner circumferential portion thereof.

In this embodiment, the "cone-shaped general spiral blade" is schematically a member in a shape in which an external diameter is continuously changed while maintaining an internal diameter constant in a general spiral blade. More specifically, the cone-shaped general spiral blade is a member with a predetermined thickness having a cone-shaped general spiral blade surface as a main surface. Here, an inner circumferential portion of the cone-shaped general spiral blade is a part that is closest to an axial line of the first rotation shaft 202*a* on the above-described cone-shaped general spiral blade surface, and an outer circumferential portion of the cone-shaped general spiral blade is a part that is farthest from the first rotation shaft 202*a* on the above-described cone-shaped general spiral blade surface.

In this embodiment, the "cone-shaped general spiral blade surface" is a surface formed by the trajectory of one line segment $L_2$ outside an imaginary circular column $K_3$ (hereinafter, a radius is $r_2$) when the line segment $L_2$ is moved in one direction $D_2$ parallel to an axial line of the imaginary circular column $K_3$ while changing so that a length $m_3$ of the line segment $L_2$ in a radial direction of the imaginary circular column $K_3$ continuously becomes larger and maintaining an attachment angle β of the line segment $L_2$ along one general spiral $C_2$ (a lead angle is $\theta_2$) on a side surface of the imaginary circular column $K_3$. Here, the "attachment angle β" is an angle formed by the line segment $L_2$ and a half-line extending in the one direction $D_2$ from a tangent point of the line segment $L_2$ and the imaginary circular column $K_3$ on a plane including the axial line of the imaginary circular column $K_3$ and the line segment $L_2$, and is an angle that is larger than 0° and smaller than 180°.

Figure 10A:
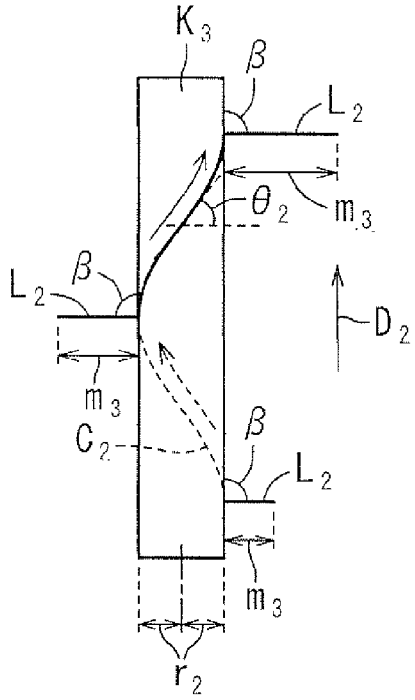
FIGS. 10A to 10D are diagrams illustrating one cyclic cone-shaped general spiral blade surface.

Hereinafter, as an example of the cone-shaped general spiral blade surface, a cone-shaped general spiral blade surface obtained when a line segment is moved along one cyclic portion of a general spiral ("one cyclic: cone-shaped general spiral blade surface"; the same applies to the other cycles) is illustrated. FIGS. 10A to 10D are diagrams illustrating the one cyclic cone-shaped general spiral blade surface. FIG. 10A shows a side surface of the imaginary circular column $K_3$, a right-handed general spiral $C_2$ on the side surface of the imaginary circular column $K_3$, and starting and end positions of the line segment $L_2$ moving in the one direction $D_2$ on the general spiral $C_2$. The line segment $L_2$ shown on the lowermost side of the sheet of FIG. 10A indicates the starting position in moving, and the line segment $L_2$ shown on the uppermost side indicates the end position. As shown in FIG. 10A, the trajectory of the line segment $L_2$ when the line segment $L_2$ is moved in the one direction $D_2$ along the general spiral $C_2$ while changing so that a length $m_3$ of the line segment $L_2$ in a radial direction of the imaginary circular column $K_3$ continuously becomes larger and constantly maintaining the attachment angle β (β=90° in FIG. 10A) of the line segment $L_2$ corresponds to a cone-shaped general spiral blade surface.

The outer circumferential portion of the cone-shaped general spiral blade surface inscribes the side surface of an imaginary truncated cone having the same axial line as the imaginary circular column $K_3$. In this embodiment, the "truncated cone" as used herein is a solid having two bottom surfaces whose areas are different from each other, whose axial line runs through the two bottom surfaces, and whose external diameter continuously becomes larger as advancing in one direction of the axial line directions thereof. The shape of the imaginary truncated cone inscribed by the cone-shaped general spiral blade surface differs depending on the way that the length $m_3$ of the line segment $L_2$ changes.

Figure 10B:
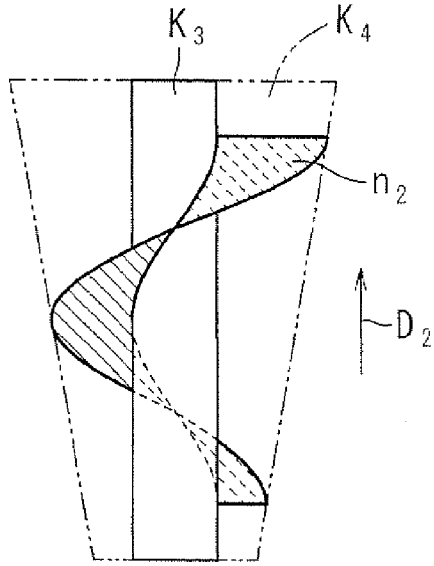

FIG. 10B shows a cone-shaped general spiral blade surface $n_2$ inscribing an imaginary right circular truncated cone $K_4$. In this embodiment, the "right circular truncated cone" is a solid which is not a circular cone among two solids obtained by dividing a right circular cone on one plane parallel to the bottom surface. The trajectory of the line segment $L_2$ when the rate of change of the length $m_3$ of the line segment $L_2$ per unit moving distance along the general spiral $C_2$ is constant, corresponds to the cone-shaped general spiral blade surface $n_2$ depicted by the hatched portion in FIG. 10B, and the outer circumferential portion thereof inscribes the side surface of the imaginary right circular truncated cone $K_4$.

Figure 10C:
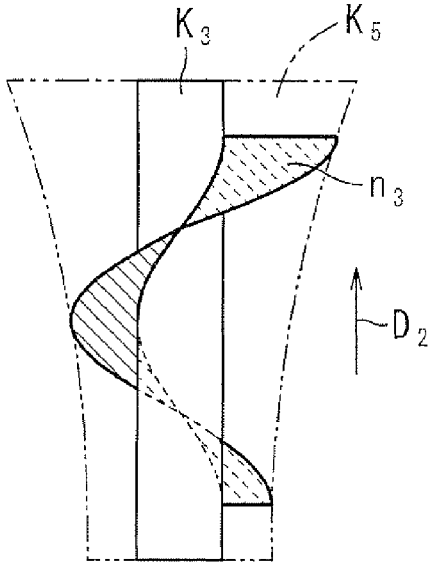

FIG. 10C shows a cone-shaped general spiral blade surface $n_3$ inscribing an imaginary compressed right circular truncated cone $K_5$. In this embodiment, the "compressed right circular truncated cone" is a solid having such a shape that the side surface of a right circular truncated cone is curved in a direction towards the axial line. The trajectory of the line segment $L_2$ when the rate of change of the length $m_3$ of the line segment $L_2$ per unit moving distance along the general spiral $C_2$ becomes gradually larger as advancing in one direction $D_2$, corresponds to the cone-shaped general spiral blade surface $n_3$ depicted by the hatched portion in FIG. 10C, and the outer circumferential portion thereof inscribes the side surface of the imaginary compressed right circular truncated cone $K_5$.

Figure 10D:
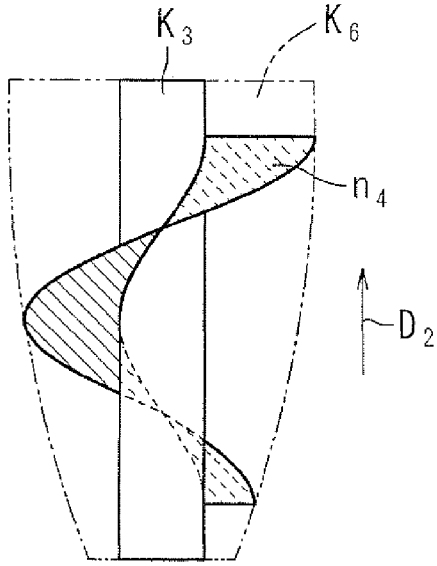

FIG. 10D shows a cone-shaped general spiral blade surface $n_4$ inscribing an imaginary expanded right circular truncated cone $K_6$. In this embodiment, the "expanded right circular truncated cone" is a solid having such a shape that the side surface of a right circular truncated cone is curved in a direction away from the axial line. The trajectory of the line segment $L_2$ when the rate of change of the length $m_3$ of the line segment $L_2$ per unit moving distance along the general spiral $C_2$ becomes gradually smaller as advancing in one direction $D_2$, corresponds to the cone-shaped general spiral blade surface $n_4$ depicted by the hatched portion in FIG. 10D, and the outer circumferential portion thereof inscribes the side surface of the imaginary expanded right circular truncated cone $K_6$.

A member with such a cone-shaped general spiral blade surface as a main surface is a cone-shaped general spiral blade. The above-described cone-shaped general spiral blade is, in the case of being used as the inner spiral blade 202*f* as in this embodiment, configured so that a diameter $2r_2$ of the imaginary circular column $K_3$ is equal to an external diameter of the first rotation shaft 202*a*. Then, the cone-shaped general spiral blade is provided so that cone-shaped general spiral blade surfaces $n_2$, $n_3$ and $n_4$ are placed on a side of the first communicating path R in the first developer conveying direction X, and is provided so as to convey a developer in the first direction $H_1$ that is the same as the first developer conveying direction X with the cone-shaped general spiral blade surface $n_2$, $n_3$ and $n_4$. In this embodiment, in order to convey the developer in the first direction $H_1$ with the cone-shaped general spiral blade surfaces $n_2$, $n_3$ and $n_4$, the cone-shaped general spiral blade needs to be a member with a cone-shaped general spiral blade surface as a main surface that is formed when a line segment is moved along the right-handed general spiral, that is, a right-handed cone-shaped general spiral blade.

Additionally, at the time, a value twice a distance between an inner circumferential portion of the cone-shaped general spiral blade and an axial line of the first rotation shaft 202*a*, that is, an internal diameter of the cone-shaped general spiral blade becomes uniformly $2r_2$, and a value twice a distance between an outer circumferential portion of the cone-shaped general spiral blade and the axial line of the first rotation shaft 202*a*, that is, an external diameter of the cone-shaped general spiral blade continuously changes from a maximum value of $2m_3+2r_2$ to a minimum value of $2m_3+2r_2$ as advancing in the first direction $H_1$. A minimum value of the length $m_3$ can be appropriately set, for example, within the range of 0 mm to 5 mm. A maximum value of the length $m_3$ can be appropriately set, for example, within the range of 8 mm to 20 mm. Note that, in this embodiment, a maximum value of the external diameter of the cone-shaped general spiral blade is equal to the external diameter of the first conveying blade 202*b*, and the cone-shaped general spiral blade continues smoothly into the first conveying blade 202*b*.

In this embodiment, the attachment angle does not need to be 90°, and can be appropriately set within the range of 30° to 150°. The lead angle $\theta_2$ can be appropriately set, for example, within the range of 20° to 70°. Additionally, a lead $m_4$ of the outer circumferential portion of the cone-shaped general spiral blade can be appropriately set, for example, within the range of 20 mm to 50 mm. Moreover, in this embodiment, an entire length $m_5$ of the cone-shaped general spiral blade in the axial line direction of the first rotation shaft 202*a* can be appropriately set, for example, within the range of 20 mm to 40 mm.

Further, in this embodiment, the inner spiral blade 2021 is a cone-shaped general spiral blade having two cyclic cone-shaped general spiral blade surfaces, and a thickness of the cone-shaped general spiral blade is uniformly 2 mm. Note that, at the time, a distance between the other end 207*b* in the longitudinal direction of the partition 207 and the inner wall of the developer tank 201 which define the first communicating path R is 30 mm. The cycle, the thickness and the like of the cone-shaped general spiral blade are can be appropriately set in accordance with a developer conveying speed, the size of the developer tank 201, the size of the first communicating path R, and the like. For example, the thickness of the cone-shaped general spiral blade used as the inner spiral blade 202*f* can be appropriately set within the range of 1.5 mm to 3 mm.

In this embodiment, the outer spiral blade 202*e* is a continuous annular general spiral blade. The annular general spiral blade is provided around the inner spiral blade 202*f* in an inner circumferential portion thereof. In this embodiment, the "annular general spiral blade" is schematically a member in a shape in which an internal diameter is continuously changed while maintaining an external diameter constant in a general spiral blade. More specifically, the annular general spiral blade is a member with a predetermined thickness having an annular general spiral blade surface as a main surface. Here, an inner circumferential portion of the annular general spiral blade is a part that is closest to an axial line of the first rotation shaft 202*a* on the above-described annular general spiral blade surface, and an outer circumferential portion of the annular general spiral blade is a part that is farthest from the first rotation shaft 202*a* on the above-described annular general spiral blade surface.

In this embodiment, the "annular general spiral blade surface" is a surface formed by the trajectory of one line segment $L_3$ inside an imaginary circular column $K_7$ (hereinafter a radius is $r_3$) when the line segment $L_3$ is moved in one direction $D_3$ parallel to an axial line of the imaginary circular column $K_7$ while changing so that a length $m_6$ of the line segment $L_3$ in a radial direction of the imaginary circular column $K_7$ continuously becomes smaller and maintaining an attachment angle $\delta$ of the line segment $L_3$ along one general spiral $C_3$ (a lead angle is $\theta_3$) on a side surface of the imaginary circular column $K_7$. Here, the "attachment angle $\delta$" is an angle formed by the line segment $L_3$ and a half-line extending in the one direction $D_3$ from a tangent point of the line segment $L_3$ and the imaginary circular column $K_7$ on a plane including the axial line of the imaginary circular column $K_7$ and the line segment $L_3$, and is an angle that is larger than 0° and smaller than 180°.

Figure 11A:
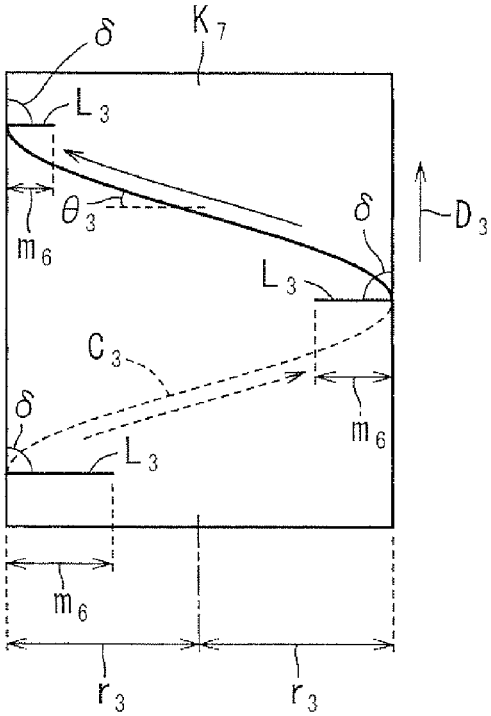
FIGS. 11A to 11D are diagrams illustrating one cyclic annular general spiral blade surface.

Hereinafter, as an example of the annular general spiral blade surface, an annular general spiral blade surface obtained when a line segment is moved along a one cyclic portion of a general spiral ("one cyclic annular general spiral blade surface"; the same applies to the other cycles) is illustrated. FIGS. 11A to 11D are diagrams illustrating the one cyclic annular general spiral blade surface. FIG. 11A shows a side surface of the imaginary circular column $K_7$, a left-handed general spiral $C_3$ on the side surface of the imaginary circular column $K_7$, and starting and end positions of the line segment $L_3$ moving in the one direction $D_3$ on the general spiral $C_3$. The line segment $L_3$ shown on the lowermost side of the sheet of FIG. 11A indicates the starting position in moving, and the line segment $L_3$ shown on the uppermost side indicates the end position. As shown in FIG. 11A, the trajectory of the line segment $L_3$ when the line segment $L_3$ is moved in the one direction $D_3$ along the general spiral $C_3$ while changing so that a length $m_6$ of the line segment $L_3$ in a radial direction of the imaginary circular column $K_7$ continuously becomes smaller and constantly maintaining the attachment angle $\delta$ ($\delta$=90° in FIG. 11A) of the line segment $L_3$ corresponds to an annular general spiral blade surface.

The inner circumferential portion of the annular general spiral blade surface circumscribes the side surface of an imaginary truncated cone having the same axial line as the imaginary circular column $K_7$. The shape of the imaginary truncated cone circumscribed by the annular general spiral blade surface differs depending on the way that the length $m_6$ of the line segment $L_3$ changes.

Figure 11B:
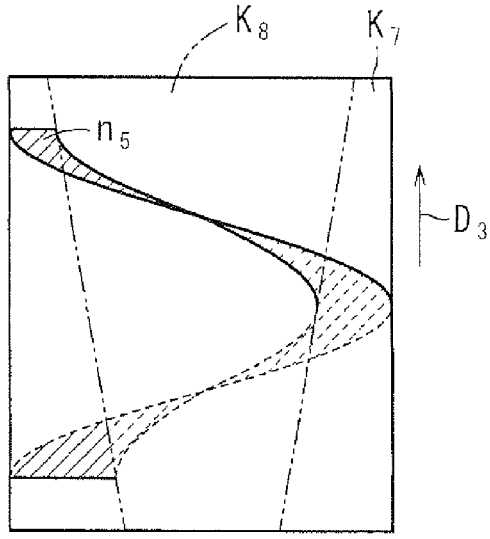

FIG. 11B shows an annular general spiral blade surface $n_5$ circumscribing an imaginary right circular truncated cone $K_8$. The trajectory of the line segment $L_3$ when the rate of change of the length $m_6$ of the line segment $L_5$ per unit moving distance along the general spiral $C_3$ is constant, corresponds to the annular general spiral blade surface $n_5$ depicted by the hatched portion in FIG. 11B, and the inner circumferential portion thereof circumscribes the side surface of the imaginary right circular truncated cone $K_8$.

Figure 11C:
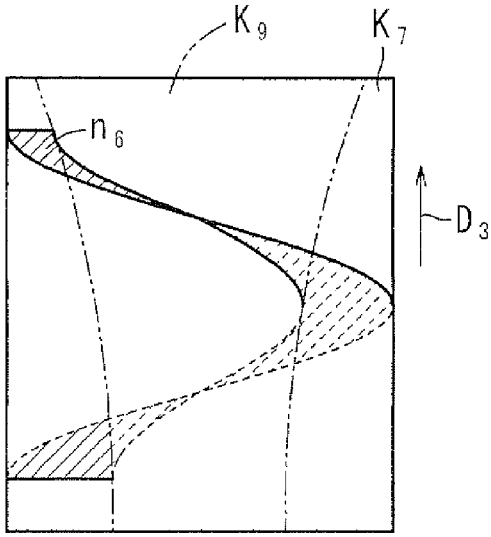
Figure 11D:
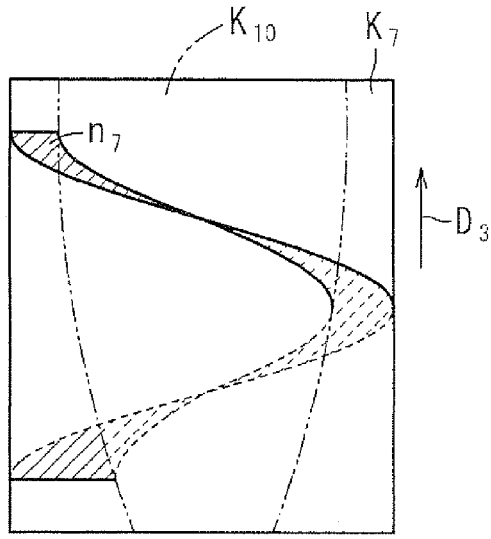

FIG. 11C shows an annular general spiral blade surface $n_6$ circumscribing the imaginary compressed right circular truncated cone $K_9$. The trajectory of the line segment $L_3$ when the rate of change of the length $m_6$ of the line segment $L_3$ per unit moving distance along the general spiral $C_3$ becomes gradually larger as advancing in the one direction $D_3$, corresponds to the annular general spiral blade surface $n_6$ depicted by the hatched portion in FIG. 11C, and the inner circumferential portion thereof circumscribes the side surface of the imaginary compressed right circular truncated cone $K_9$.

FIG. 110 shows an annular general spiral blade surface $n_7$ circumscribing an imaginary expanded right circular truncated cone $K_{10}$. The trajectory of the line segment $L_3$ when the rate of change of the length $m_6$ of the line segment $L_3$ per unit moving distance along the general spiral $C_3$ becomes gradually smaller as advancing in one direction $D_3$, corresponds to the annular general spiral blade surface $n_7$ depicted by the hatched portion in FIG. 11, and the inner circumferential portion thereof circumscribes the side surface of the imaginary expanded right circular truncated cone $K_{10}$.

A member with such an annular general spiral blade surface as a main surface is an annular general spiral blade. The above-described annular general spiral blade is, in the case of being used as the outer spiral blade 202*e* as in this embodiment, provided so that the annular general spiral blade surfaces $n_5$, $n_6$ and $n_7$ are placed on a side of the second communicating path S in the first developer conveying direction X, and provided so as to convey a developer in the second direction $H_2$ that is opposite to the first developer conveying direction X with the annular general spiral blade surfaces $n_5$, $n_6$ and $n_7$. In this embodiment, in order to convey the developer in the second direction $H_2$ with the annular general spiral blade surfaces $n_5$, $n_6$ and $n_7$, the annular general spiral blade needs to be a member with the annular general spiral blade surface as a main surface that is formed when a line segment is moved along the left-handed general spiral, that is, a left-handed annular general spiral blade. Additionally, the annular general spiral blade is provided so that the inner spiral blade 202*f* is present on an inner side from a side surface of an imaginary truncated cone circumscribed in an inner circumferential portion thereof. At the time, the inner spiral blade 202*f* and the annular general spiral blade may be connected by means of a resin, a metal or the like at one or a plurality of adjacent parts.

Further, when the annular general spiral blade is used as the outer spiral blade 202*e*, a value twice a distance between an outer circumferential portion of the annular general spiral blade and an axial line of the first rotation shaft 202*a*, that is, an external diameter of the annular general spiral blade, becomes uniformly $2r_3$, and a value twice a distance between an inner circumferential portion of the annular general spiral blade and the axial line of the first rotation shaft 202*a*, that is, an internal diameter of the annular general spiral blade, continuously changes from a minimum value of $2m_6+2r_3$ to a maximum value of $2m_6+2r_3$ as advancing in the second direction $H_2$. A minimum value of the length $m_6$ can be appropriately set, for example, within the range of 0 mm to 5 mm. A maximum value of the length $m_6$ can be appropriately set, for example, within the range of 8 mm to 20 mm. Note that, in this embodiment, a maximum value of the external diameter of the annular general spiral blade is equal to the external diameter of the first conveying blade 202*b*.

In this embodiment, the attachment angle δ does not need to be 90°, and can be appropriately set within the range of 30° to 150°. A lead angle $\theta_3$ can be appropriately set, for example, within the range of 20° to 70°. Further, a lead $m_7$ of the outer circumferential portion of the annular general spiral blade in this embodiment can be appropriately set, for example, within the range of 10 mm to 25 mm. Additionally, in this embodiment, an entire length $m_8$ of the annular general spiral blade in the axial line direction of the first rotation shaft 202*a* can be appropriately set, for example, within the range of 20 mm to 40 mm.

Further, in this embodiment, the outer spiral blade 202*e* is an annular general spiral blade having one and three fourths cyclic annular general spiral blade surfaces, and the thickness of the annular general spiral blade is uniformly 2 mm. The cycle, the thickness and the like of the annular general spiral blade can be appropriately set in accordance with a developer conveying speed, the size of the developer tank 201, the size of the first communicating path R, and the like. For example, the thickness of the annular general spiral blade used as the outer spiral blade 202*e* can be appropriately set within the range of 1.5 mm to 3 mm.

In this embodiment, as described above, the cone-shaped general spiral blade is used as the inner spiral blade 202*f*, and the annular general spiral blade is used as the outer spiral blade 202*e*. The cone-shaped general spiral blade is configured so that an amount of the developer conveyed in the first direction $H_1$ becomes gradually smaller as advancing in the first direction $H_1$. The annular general spiral blade is configured so that an amount of the developer conveyed in the second direction $H_2$ becomes gradually smaller as advancing in the second direction $H_2$. In this manner, the double spiral blade 202*d* is configured so that the amount of the developer conveyed in the second direction $H_2$ is small in a place where the amount of the developer conveyed in the first direction $H_1$ is large, and the amount of the developer conveyed in the first direction $H_1$ is small in a place where the amount of the developer conveyed in the second direction $H_2$ is large. As a result, since rapid repelling is prevented from occurring due to two flows of the developer whose directions that are generated with the double spiral blade 202*d* are different from each other, it is possible to suppress a load on the developer due to repelling. Note that, in a case where an imaginary truncated cone inscribed by a cone-shaped general spiral blade and an imaginary truncated cone circumscribed by an annular general spiral blade are expanded right circular truncated cones, it is possible to further suppress the load on the developer due to repelling, which is more preferable.

As in this embodiment, when the cone-shaped general spiral blade is used as the inner spiral blade 202*f*, and the annular general spiral blade is used as the outer spiral blade 202*e*, it is preferred to be configured so that the imaginary truncated cone inscribed by the cone-shaped general spiral blade coincides with the imaginary truncated cone circumscribed by the annular general spiral blade. Suppression of the load on the developer with the double spiral blade 202*d* is achieved even when the imaginary truncated cone circumscribed by the outer spiral blade 202*e* is made larger than the imaginary truncated cone inscribed by the inner spiral blade 202*f*, or at least one of the inner spiral blade 202*f* and the outer spiral blade 202*e* serves as a general spiral blade, however, the inner spiral blade 202*f* and the outer spiral blade 202*e* whose imaginary truncated cones coincide with each other are used so that a clearance between the inner spiral blade 202*f* and the outer spiral blade 202*e* disappears when the double spiral blade 202*d* is viewed from a position that separates in the axial line direction of the first rotation shaft 202*a*, and it is thus possible to further suppress the load applied to the developer.

It is preferable that the lead $m_7$ of the outer circumferential portion of the outer spiral blade 202*e* is smaller than the lead $m_4$ of the outer circumferential portion of the inner spiral blade 202*f*. The second direction $H_2$ that is a conveying direction of a developer with the outer spiral blade 202*e* is a direction that is opposite to the first developer conveying direction X. Accordingly, the lead $m_7$ of the outer circumferential portion of the outer spiral blade 202*e* is made smaller so that it is possible to circulate and convey the developer more smoothly.

The outer spiral blade 202*e* may be formed of materials such as polyethylene, polypropylene, high-impact polystyrene and an ABS resin as in the inner spiral blade 202*f*, however, it is preferably formed of an elastic sponge. In this embodiment, the "elastic sponge" has a quality of a material with a compression deformation rate of 50% or more and 80% or less. Here, the compression deformation rate is a value given by the following expression (1), where F[cm] represents a minimum value of a thickness of a cubic sample with 1 cm of each side when a load at 0.1 $N/cm^2$/second is applied in a thickness direction with respect to the sample.

$$\text{Compression deformation rate}[\%]=(1-F)\times 100[\%] \quad (1)$$

by forming the outer spiral blade 202*e* of such an elastic sponge, it is possible to suppress a load applied to a developer due to repelling of two flows of the developer whose directions that are generated with the double spiral blade 202*d* are different from each other.

Each opening of the elastic sponge preferably has such a size that a toner cannot enter into the opening. Specifically, an opening area is, for example, 1 $\mu m^2$ or more and 10 $\mu m^2$. Moreover, an opening diameter is, for example, by 1 μm or more and 3 μm or less. By forming openings having such a size, it is possible increase friction between the developer and the elastic sponge while preventing the toner from entering into the openings. In this way, the developer can easily move together with the outer spiral blade 202*e*. Accordingly, even when the mobility of the developer decreases, it is possible to move the developer and suppress an increase of driving torque.

As for the elastic sponge, an urethane sponge, a rubber sponge, a polyethylene sponge or the like can be used, and among these, the urethane sponge having excellent abrasion resistance is preferred. The use of a urethane sponge as the elastic sponge enables the life of the developing device 200 to be extended. Further, as the elastic sponge, a continuous foam sponge having continuous foams is preferred. Since the continuous foam sponge is easily compressed or deformed compared to a single foam sponge, it is possible to suppress the excessive compression of a developer. The continuous foam sponge is obtained by a method of subjecting a kneaded material of fine calcium carbonate particles to injection molding and dipping the molded product into a hydrochloric acid solution, thus decomposing and eluting calcium carbonate powder. Alternatively, a method of molding a kneaded material of water-soluble salt and eluting the salt in water to obtain a continuous foam structure, and a method of adding a foaming agent in a resin in advance and physically breaking the walls of foams after the foaming process may be used.

Further, as the elastic sponge, a conductive sponge containing a conductive agent such as carbon black is preferred. Since the conductive sponge is hard to be charged even when it is brushed on the developer or against the inner wall surface of the developer tank 201, it is possible to suppress the toner from being electrostatically absorbed to the conductive sponge.

Figure 12:
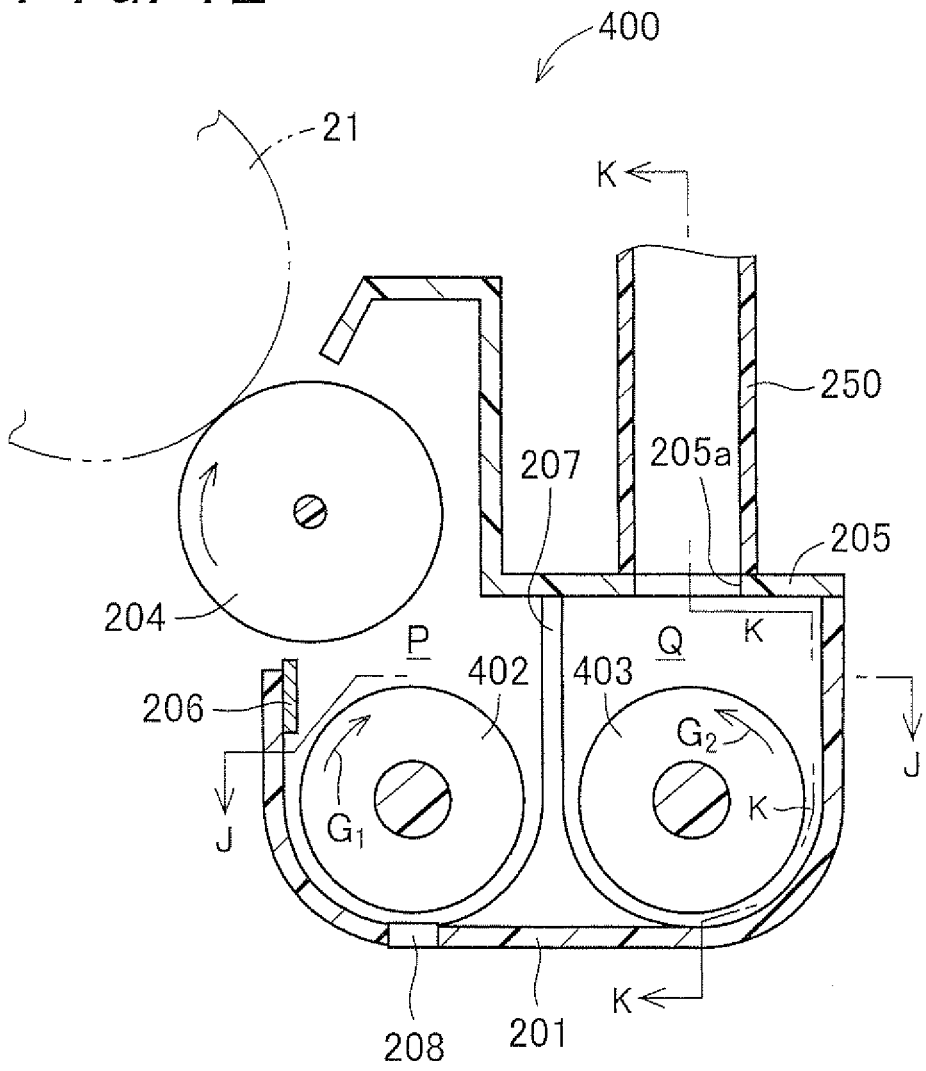
FIG. 12 is a schematic view showing a configuration of a developing device.
Figure 13:
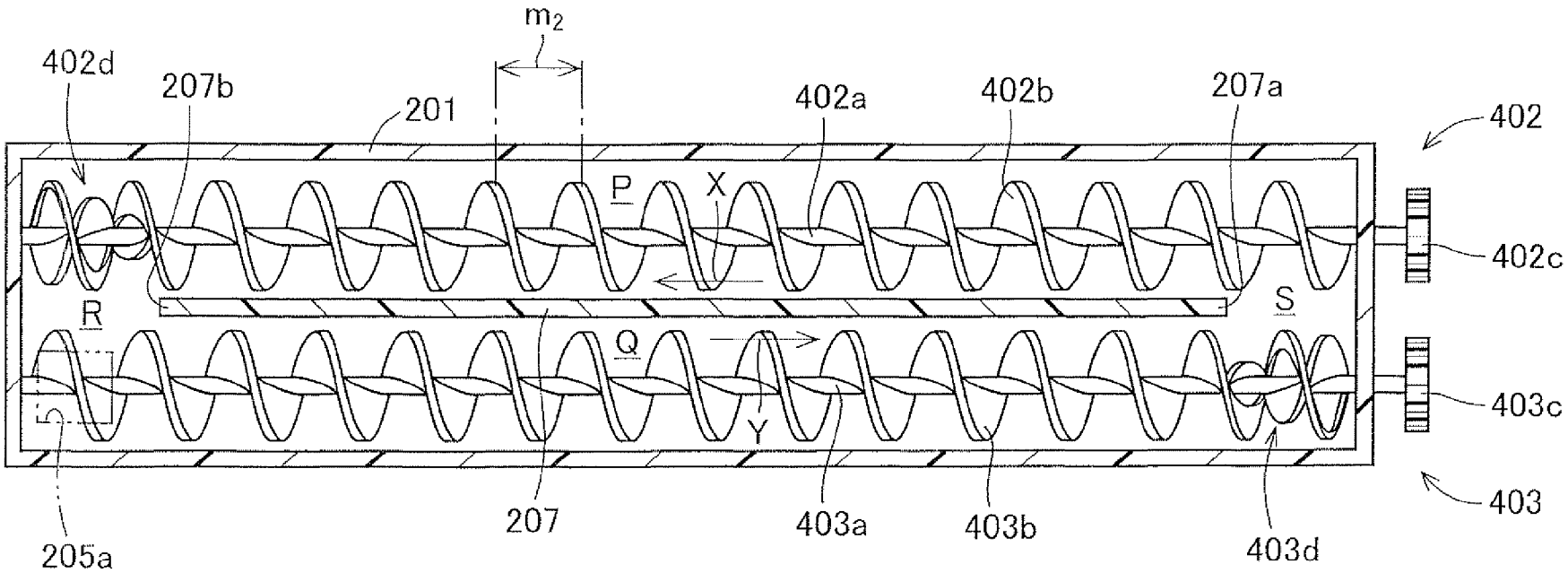
FIG. 13 is a sectional view of the developing device taken along the line J-J of FIG. 12.
Figure 14:
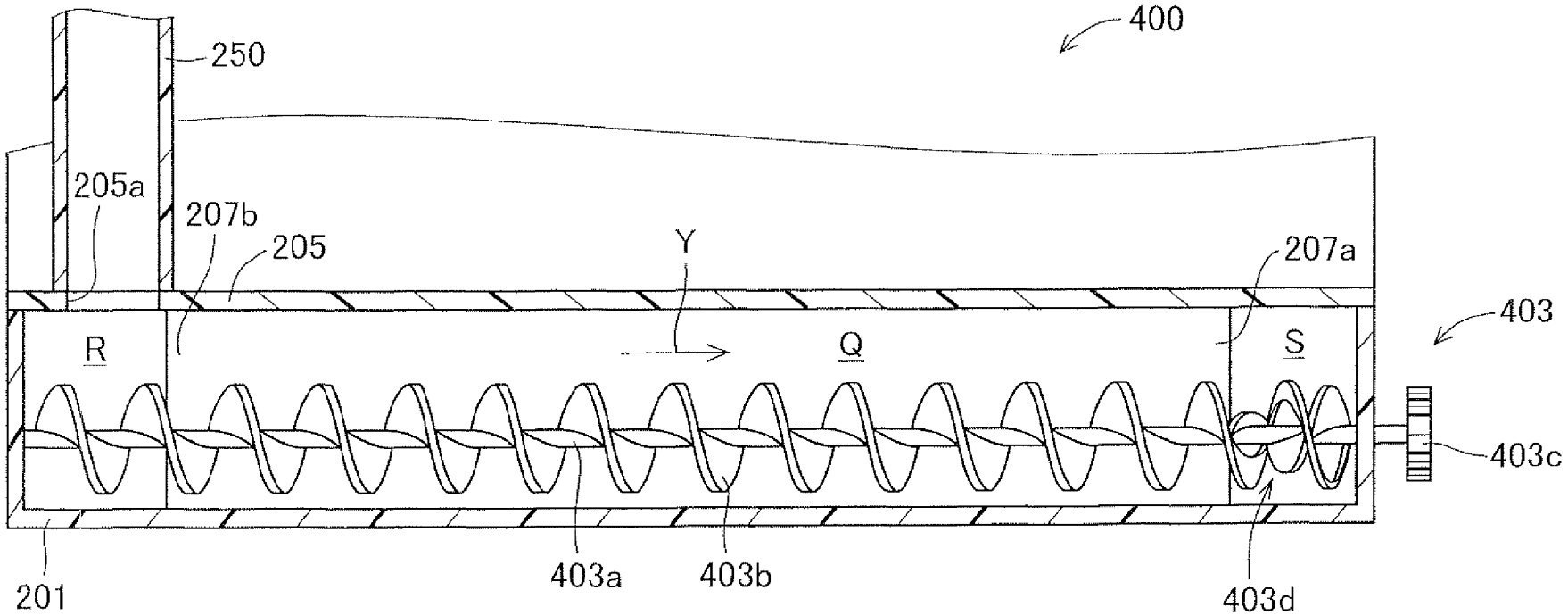
FIG. 14 is a sectional view of the developing device taken along the line K-K of FIG. 12.

Next, a developing device 400 according to a second embodiment will be described. FIG. 12 is a schematic view showing a configuration of the developing device 400. FIG. 13 is a sectional view of the developing device 400 taken along the line J-J of FIG. 12. FIG. 14 is a sectional view of the developing device 400 taken along the line K-K of FIG. 12. The developing device 400 is provided in the image forming apparatus 100 in place of the developing device 200, and is a device that develops an electrostatic latent image formed on a surface of the photoreceptor drum 21 by supplying a toner onto the surface. The developing device 400 includes the developer tank 201, a first developer conveying member 402, a second developer conveying member 403, the developing roller 204, the developer tank cover 205, the doctor blade 206, the partition 207 and the toner concentration detection sensor 208.

The developing device 400 is provided with the first developer conveying member 402 in place of the first developer conveying member 202, and the second developer conveying member 403 in place of the second developer conveying member 203. Therefore, description is omitted for the developer tank 201, the developing roller 204, the developer tank cover 205, the doctor blade 206, the partition 207 and the toner concentration detection sensor 208, which are members that are in common to the first embodiment and the second embodiment. Note that, as another embodiment, in the developing device 200, the first developer conveying member 402 may be provided in place of the first developer conveying member 202, and may maintain the second developer conveying member 203 as it is.

The first developer conveying member 402 is provided in the first conveyance path P, and includes a first rotation shaft 402*a*, a first conveying blade 402*b* and a first conveying gear 402*c*. Each of the first rotation shaft 402*a*, the first conveying blade 402*b* and the first conveying gear 402*c* has the same shape as each of the first rotation shaft 202*a*, the first conveying blade 202*b* and the first conveying gear 202*c* in the first embodiment, which description is thus omitted. The second developer conveying member 403 is provided in a second conveyance path Q, and includes a second rotation shaft 403*a*, a second conveying blade 403*b* and a second conveying gear 403*c*. Each of the second rotation shaft 403*a*, the second conveying blade 403*b* and the second conveying gear 403*c* has the same shape as each of the second rotation shaft 203*a*, the second conveying blade 203*b* and the second conveying gear 203*c* in the first embodiment, which description is thus omitted.

In this embodiment, the first developer conveying member 402 has a double spiral blade 402*d* on a downstream side in the first developer conveying direction X from the first conveying blade 402*b*, and the second developer conveying member 403 has a double spiral blade 403*d* on a downstream side in the second developer conveying direction Y from the second conveying blade 403*b*.

Figure 15:
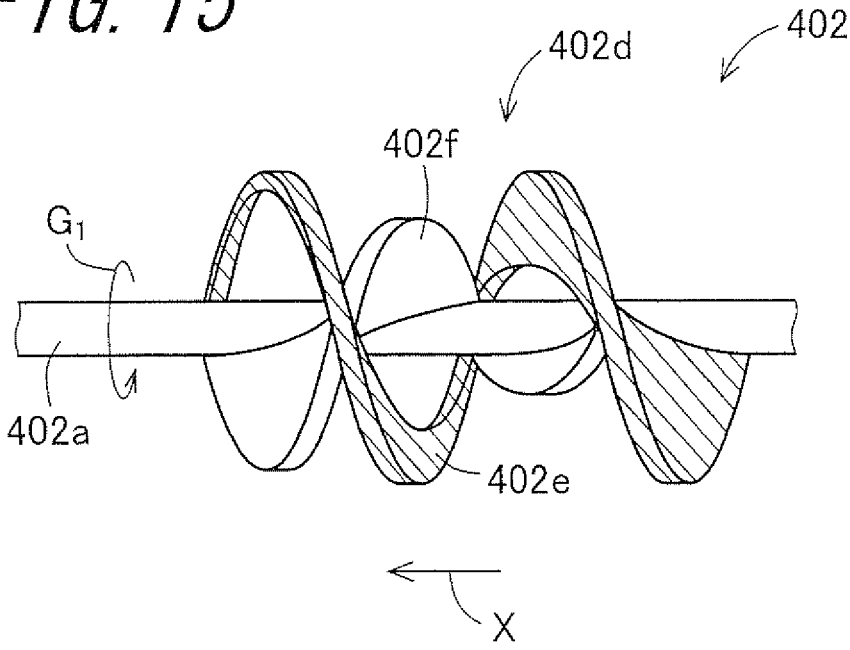
FIG. 15 is a schematic view showing a configuration of a double spiral blade.
Figure 16B:
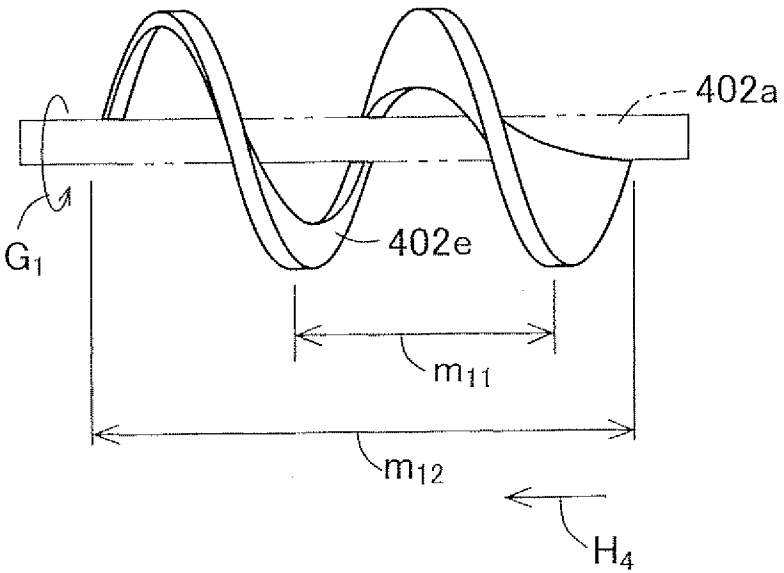
FIG. 16B is a diagram showing an outer spiral blade of the double spiral blade.
Figure 16A:
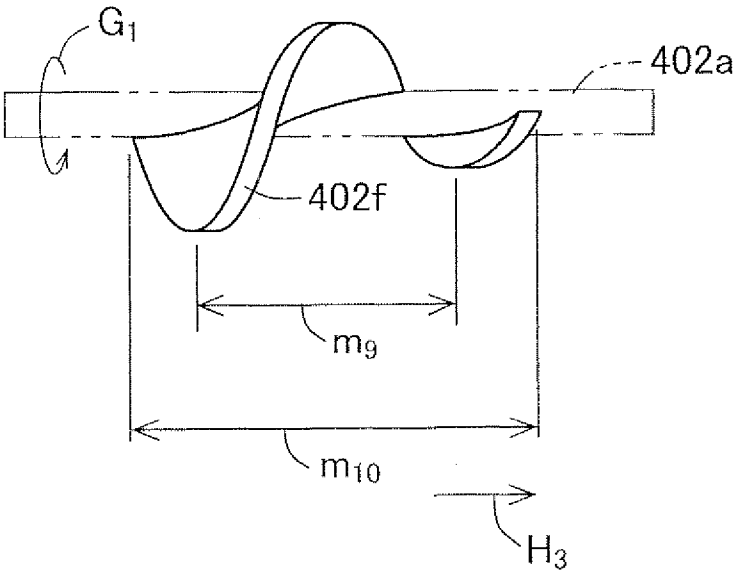
FIG. 16A is a diagram showing an inner spiral blade of the double spiral blade.

Hereinafter, description will be given for the double spiral blade 402*d* of the first developer conveying member 402. Note that, the second developer conveying member 403 has the same shape as the first developer conveying member 402, which description is thus omitted. FIG. 15 is a schematic view showing a configuration of the double spiral blade 402*d*. The double spiral blade 402*d* includes an outer spiral blade 402*e* depicted by a hatched portion in FIG. 15 and an inner spiral blade 402*f*. FIG. 16A is a diagram showing the inner spiral blade 402*f* of the double spiral blade 402*d*, and FIG. 16B is a diagram showing the outer spiral blade 402*e* of the double spiral blade 402*d*. In FIG. 16A, the inner spiral blade 402*f* is depicted by a solid line, and the first rotation shaft 402*a* is depicted by a two-dotted chain line. In FIG. 163, the outer spiral blade 402*e* is depicted by a solid line, and the first rotation shaft 402*a* is depicted by a two-dotted chain line.

As shown in FIG. 16A, the inner spiral blade 402*f* is provided around the first rotation shaft 402*a*. The inner spiral blade 402*f* performs rotation motion around an axial line of the first rotation shaft 402*a* following rotation of the first rotation shaft 402*a* in the rotation direction $G_1$. The inner spiral blade 402*f* conveys, with the rotation motion, a developer which is at a position relatively near to the first rotation shaft 402*a* in a second direction $H_3$ that is an opposite direction to the first developer conveying direction X.

As shown in FIG. 16B, the outer spiral blade 402*e* is provided around the inner spiral blade 402*f*. The outer spiral blade 402*e* performs rotation motion around the axial line of the first rotation shaft 402*a* following rotation of the first rotation shaft 402*a* in the rotation direction $G_1$. The outer spiral blade 402*e* conveys, with the rotation motion, a developer which is at a position relatively far from the first rotation shaft 402*a* in a first direction $H_4$ that is the same direction as the first developer conveying direction X. Namely, the first developer conveying member 402 in this embodiment is configured so that the first direction $H_4$ in which the developer is conveyed with the outer spiral blade 402*e* is a direction which is the same as the first developer conveying direction X.

When the double spiral blade 402*d* performs rotation motion as described above, a flow of a developer that advances in the second direction $H_3$ and a flow of a developer that advances in the first direction $H_4$ are generated at a position where the inner spiral blade 402*f* and the outer spiral blade 402*e* coexist in an axial line direction of the first rotation shaft 402*a*. Two flows of the developer whose directions are different from each other are thereby generated around a position where the double spiral blade 402*d* is provided in the first rotation shaft 402*a* at the same time. Since the two flows of the developer whose directions are different from each other repel each other, the developer which is at the position relatively far from the first rotation shaft 402*a* is biased in a direction that separates from the first rotation shaft 402*a*. As a result, it is possible to guide the developer to the first communicating path R without generation of an excessive pressure against the developer, and to circulate and convey the developer while suppressing a load applied to the developer. In this embodiment, not only the first developer conveying member 402 has the double spiral blade 402*d*, but also the second developer conveying member 403 has the double spiral blade 403*d*, so that the developer on a downstream side in a second developer conveying direction Y in the second conveyance path Q is guided to the second communicating path S with a less load. As a result, it is possible circulate and convey the developer more smoothly.

Further, in this embodiment, a direction of a flow of the developer that is stored in the developer tank 201 is a left-handed direction in the case of being viewed from a vertically upper side of the developer tank 201, and the rotation direction $G_1$ of the first rotation shaft 402*a* is also a left-handed direction in the case of being viewed in the first developer conveying direction X. Namely, the first developer conveying member 402 is configured so that the rotation direction $G_1$ of the first rotation shaft 402*a* in the case of being viewed in the first developer conveying direction X coincides with the direction of the flow of the developer in the case of being viewed from the vertically upper side of the developer tank 201. Therefore, the inner spiral blade 402*f* and the outer spiral blade 402*e* of the first developer conveying member 402 come to pass through from the upper side to the lower side in the vertical direction with respect to the developer at a position facing the first communicating path R. Accordingly, the developer to be biased to a side of the first communicating path R with repelling due to the above-described two flows of the developer whose directions are different from each other is biased also to the vertically lower side due to friction with the inner spiral blade 402*f* and the outer spiral blade 402*e* thereto. As a result, the developer biased to the side of the first communicating path R with the double spiral blade 402*d* of the first developer conveying member 402 is prevented from going back to the first conveyance path P, and it is thus possible to circulate and convey the developer more smoothly.

The inner spiral blade 402*f* is formed of materials such as polyethylene, polypropylene, high-impact polystyrene and an ABS resin. In this embodiment, the inner spiral blade 402*f* is a continuous cone-shaped general spiral blade. The cone-shaped general spiral blade is provided around the first rotation shaft 402*a* in an inner circumferential portion thereof. Hereinafter, description will be given for the cone-shaped general spiral blade with use of FIGS. 10A to 10D used for the description of the first embodiment.

The cone-shaped general spiral blade is configured so that a diameter $2r_2$ of the imaginary circular column $K_3$ shown in FIGS. 10A to 10D is equal to an external diameter of the first rotation shaft 402*a*. Then, the cone-shaped general spiral blade is provided so that cone-shaped general spiral blade surfaces $n_2$, $n_3$ and $n_4$ shown in FIGS. 10A to 10D are placed on a side of the second communicating path S in the first developer conveying direction X, and is provided so as to convey a developer in the second direction $H_3$ that is opposite to the first developer conveying direction X with the cone-shaped general spiral blade surface $n_2$, $n_3$ and $n_4$. In this embodiment, in order to convey the developer in the second direction $H_3$ with the cone-shaped general spiral blade surfaces $n_2$, $n_3$ and $n_4$, the cone-shaped general spiral blade needs to be a left-handed cone-shaped general spiral blade.

Additionally, at the time, a value twice a distance between an inner circumferential portion of the cone-shaped general spiral blade and an axial line of the first rotation shaft 402*a*, that is, an internal diameter of the cone-shaped general spiral blade, becomes uniformly $2r_2$, and a value twice a distance between an outer circumferential portion of the cone-shaped general spiral blade and the axial line of the first rotation shaft 402*a*, that is, an external diameter of the cone-shaped general spiral blade, continuously changes from a maximum value of $2m_3+2r_2$ to a minimum value of $2m_3+2r_2$ as advancing in the second direction $H_3$. A minimum value of the length $m_3$ can be appropriately set, for example, within the range of 0 mm to 5 mm. A maximum value of the length $m_3$ can be appropriately set, for example, within the range of 8 mm to 20 mm. Note that, in this embodiment, a maximum value of the external diameter of the cone-shaped general spiral blade is equal to the external diameter of the first conveying blade 402*b*.

In this embodiment, the attachment angle β does not need to be 90°, and can be appropriately set within the range of 30° to 150°. The lead angle $\theta_2$ can be appropriately set, for example, within the range of 40° to 70°. Additionally, a lead $m_9$ of the outer circumferential portion of the cone-shaped general spiral blade can be appropriately set, for example, within the range of 20 mm to 40 mm. Moreover, in this embodiment, an entire length $m_{10}$ of the cone-shaped general spiral blade in the axial line direction of the first rotation shaft 402*a* can be appropriately set, for example, within the range of 20 mm to 40 mm.

Further, in this embodiment, the inner spiral blade 402*f* is a cone-shaped general spiral blade having one and half cyclic cone-shaped general spiral blade surfaces, and the thickness of the cone-shaped general spiral blade is uniformly 2 mm. The cycle, the thickness and the like of the cone-shaped general spiral blade can be appropriately set in accordance with a developer conveying speed, the size of the developer tank 201, the size of the first communicating path R, and the like. For example, the thickness of the cone-shaped general spiral blade used as the inner spiral blade 4021 can be appropriately set within the range of 1.5 mm to 3 mm.

In this embodiment, the outer spiral blade 402*e* is a continuous annular general spiral blade. The annular general spiral blade is provided around the inner spiral blade 402*f* in an inner circumferential portion thereof. Hereinafter, description will be given for the annular general spiral blade in this embodiment with use of FIGS. 11A to 11D used for the description of the first embodiment.

The annular general spiral blade is provided so that annular general spiral blade surfaces $n_5$, $n_6$ and $n_7$ shown in FIGS. 11A to 11D are placed on a side of the first communicating path R in the first developer conveying direction X, and provided so as to convey a developer in the first direction $H_4$ that is the same as the first developer conveying direction X with the annular general spiral blade surfaces $n_5$, $n_6$ and $n_7$. In this embodiment, in order to convey the developer in the first direction $H_4$ with the annular general spiral blade surfaces $n_5$, $n_6$ and $n_7$, the annular general spiral blade needs to be a right-handed annular general spiral blade. Additionally, the annular general spiral blade is provided so that the inner spiral blade 402*f* is present on an inner side of a side surface of an imaginary truncated cone circumscribed in an inner circumferential portion thereof. At the time, the inner spiral blade 402*f* and the annular general spiral blade may be connected by means of a resin, a metal or the like at one or a plurality of adjacent parts.

Further, when the annular general spiral blade is used as the outer spiral blade 402*e*, a value twice a distance between an outer circumferential portion of the annular general spiral blade and an axial line of the first rotation shaft 402*a*, that is, an external diameter of the annular general spiral blade, becomes uniformly $2r_3$, and a value twice a distance between an inner circumferential portion of the annular general spiral blade and the axial line of the first rotation shaft 402*a*, that is, an internal diameter of the annular general spiral blade, continuously changes from a minimum value of $2m_6+2r_3$ to a maximum value of $2m_6+2r_3$ as advancing in the first direction $H_4$. A minimum value of the length $m_6$ can be appropriately set, for example, within the range of 0 mm to 5 mm. A maximum value of the length $m_6$ can be appropriately set, for example, within the range of 8 mm to 20 mm. Note that, in this embodiment, a maximum value of the external diameter of the annular general spiral blade is equal to the external diameter of the first conveying blade 402*b*, and the annular general spiral blade continues smoothly into the first conveying blade 402*b*.

In this embodiment, the attachment angle δ does not need to be 90°, and can be appropriately set within the range of 30° to 150°. The lead angle $\theta_3$ can be appropriately set, for example, within the range of 40° to 70°. Further, a lead $m_{11}$ of the outer circumferential portion of the annular general spiral blade in this embodiment can be appropriately set, for example, within the range of 20 mm to 50 mm. Additionally, in this embodiment, an entire length $m_{12}$ of the annular general spiral blade in an axial line direction of the first rotation shaft 402*a* can be appropriately set, for example, within the range of 20 mm to 40 mm.

Further, in this embodiment, the outer spiral blade 402*e* is an annular general spiral blade having two cyclic annular general spiral blade surfaces, and the thickness of the annular general spiral blade is uniformly 2 mm. The cycle, the thickness and the like of the annular general spiral blade can be appropriately set in accordance with a developer conveying speed, the size of the developer tank 201, the size of the first communicating path R, and the like. For example, the thickness of the annular general spiral blade used as the outer spiral blade 402*e* can be appropriately set within the range of 1.5 mm to 3 mm.

In this embodiment, as described above, the cone-shaped general spiral blade is used as the inner spiral blade 402*f*, and the annular general spiral blade is used as the outer spiral blade 402*e*. The cone-shaped general spiral blade is configured so that an amount of the developer conveyed in the second direction $H_3$ becomes gradually smaller as advancing in the second direction $H_3$. The annular general spiral blade is configured so that an amount of the developer conveyed in the first direction $H_4$ becomes gradually smaller as advancing in the first direction $H_4$. Here, the first direction $H_4$ is a direction that is the same as the first developer conveying direction X, and a direction that goes to an inner wall of the developer tank 201. As described above, the amount of the developer conveyed in the first direction $H_4$ becomes smaller as advancing in the first direction $H_4$, that is, as advancing in the inner wall of the developer tank. As a result, the developer is prevented from being compressed with the inner wall of the developer tank 201 and the outer spiral blade 402*e*, and it is thus possible to suppress a load applied to the developer.

Further, as described above, the double spiral blade 402*d* is configured so that the amount of the developer conveyed in the first direction $H_4$ is small in a place where the amount of the developer conveyed in the second direction $H_3$ is large, and the amount of the developer conveyed in the second direction $H_3$ is small in a place where the amount of the developer conveyed in the first direction $H_4$ is large. As a result, since rapid repelling is prevented from occurring with two flows of the developer whose directions that are generated with the double spiral blade 402*d* are different from each other, it is possible to suppress a load on the developer due to repelling. Note that, in a case where an imaginary truncated cone inscribed by a cone-shaped general spiral blade and an imaginary truncated cone circumscribed by an annular general spiral blade are expanded right circular truncated cones, it is possible to further suppress the load on the developer due to repelling, which is more preferable.

As in this embodiment, when the cone-shaped general spiral blade is used as the inner spiral blade 402*f*, and the annular general spiral blade is used as the outer spiral blade 402*e*, it is preferred to be configured so that the imaginary truncated cone inscribed by the cone-shaped general spiral blade coincides with the imaginary truncated cone circumscribed by the annular general spiral blade. Suppression of the load on the developer with the double spiral blade 402*d* is achieved even when the imaginary truncated cone circumscribed by the outer spiral blade 402*e* is made larger than the imaginary truncated cone inscribed by the inner spiral blade 402*f*, or at least one of the inner spiral blade 402*f* and the outer spiral blade 402*e* serves as a general spiral blade, however, the inner spiral blade 402*f* and the outer spiral blade 402*e* whose imaginary truncated cones coincide with each other are used so that a clearance between the inner spiral blade 402*f* and the outer spiral blade 402*e* disappears when the double spiral blade 402*d* is viewed from a position that separates in the axial line direction of the first rotation shaft 402*a*, and it is thus possible to further suppress the load applied to the developer.

It is preferred that the lead $m_9$ of the outer circumferential portion of the inner spiral blade 4021 is smaller than a lead $m_{11}$ of the outer circumferential portion of the outer spiral blade 402*e*. The second direction $H_3$ that is a conveying direction of a developer with the inner spiral blade 402*f* is a direction that is opposite to the first developer conveying direction X. Accordingly, the lead $m_9$ of the outer circumferential portion of the inner spiral blade 4021 is made smaller so that it is possible to circulate and convey the developer more smoothly.

The outer spiral blade 402*e* may be formed of materials such as polyethylene, polypropylene, high-impact polystyrene and an ABS resin as in the inner spiral blade 402*f*, however, it is preferably formed of an elastic sponge as in the outer spiral blade 202*e* in the first embodiment.

The image forming apparatus 100 according to the technology is provided with a developing device selected as appropriate from among the developing device 200 and the developing device 400 as described above. A load on a developer is thereby suppressed, and as a result, the image forming apparatus 100 can suppress degradation of an image quality.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A developing device comprising:

a developer tank that stores a developer;

a partition that partitions an internal space of the developer tank into a first conveyance path along a longitudinal direction of the partition, a second conveyance path opposing to the first conveyance path with the partition interposed therebetween, and first and second communicating paths communicating with the first conveyance path and the second conveyance path at both ends in the longitudinal direction of the partition;

a first developer conveying member that is provided in the first conveyance path, and has a first rotation shaft which rotates around an axial line thereof, and a first conveying blade provided around the first rotation shaft, the first developer conveying member conveying the developer stored in the developer tank in a first developer conveying direction along the axial line of the first rotation shaft with rotation motion of the first conveying blade following rotation of the first rotation shaft;

a second developer conveying member that is provided in the second conveyance path, and has a second rotation shaft which rotates around an axial line thereof, and a second conveying blade provided around the second rotation shaft, the second developer conveying member conveying the developer stored in the developer tank in a second developer conveying direction, which is opposite to the first developer conveying direction, along the axial line of the second rotation shaft with rotation motion of the second conveying blade following rotation of the second rotation shaft;

a double spiral blade that is provided facing the first communicating path on a downstream side from the first conveying blade of the first developer conveying member in the first developer conveying direction, and comprises an inner spiral blade that is provided around the first rotation shaft of the first developer conveying member and conveys the developer stored in the developer tank in a first direction among axial line directions of the first rotation shaft with rotation motion following rotation of the first rotation shaft, and an outer spiral blade that is provided around the inner spiral blade and conveys the developer stored in the developer tank in a second direction among the axial line directions; and a developing roller that bears and conveys the developer, wherein the first developer conveying member is configured so that the first developer conveying direction is a same direction as the first direction, and wherein the inner spiral blade is a cone-shaped general spiral blade whose internal diameter is constant and external diameter becomes continuously smaller as advancing in the first direction, and the outer spiral blade is an annular general spiral blade whose external diameter is constant and internal diameter becomes continuously larger as advancing in the second direction.

2. The developing device of claim 1, wherein the first developer conveying member is configured so that a rotation direction of the first rotation shaft of the first conveying member, when viewed in the first developer conveying direction, is a right-handed direction when a direction of a flow of the developer stored in the developer tank is a right-handed direction in a case of being viewed from a vertically upper side of the developer tank, and a left-handed direction when a direction of a flow of the developer stored in the developer tank is a left-handed direction in a case of being viewed from a vertically upper side of the developer tank.

3. The developing device of claim 1, wherein the outer spiral blade is formed of an elastic sponge.

4. An electrophotographic image forming apparatus comprising the developing device of claim 1.

5. A developing device comprising:

a developer tank that stores a developer;

a partition that partitions an internal space of the developer tank into a first conveyance path along a longitudinal direction of the partition, a second conveyance path opposing to the first conveyance path with the partition interposed therebetween, and first and second communicating paths communicating with the first conveyance path and the second conveyance path at both ends in the longitudinal direction of the partition;

a first developer conveying member that is provided in the first conveyance path, and has a first rotation shaft which rotates around an axial line thereof, and a first conveying blade provided around the first rotation shaft, the first developer conveying member conveying the developer stored in the developer tank in a first developer conveying direction along the axial line of the first rotation shaft with rotation motion of the first conveying blade following rotation of the first rotation shaft;

a second developer conveying member that is provided in the second conveyance path, and has a second rotation shaft which rotates around an axial line thereof, and a second conveying blade provided around the second rotation shaft, the second developer conveying member conveying the developer stored in the developer tank in a second developer conveying direction, which is opposite to the first developer conveying direction, along the axial line of the second rotation shaft with rotation motion of the second conveying blade following rotation of the second rotation shaft;

a double spiral blade that is provided facing the first communicating path on a downstream side from the first conveying blade of the first developer conveying member in the first developer conveying direction, and comprises an inner spiral blade that is provided around the first rotation shaft of the first developer conveying member and conveys the developer stored in the developer tank in a first direction among axial line directions of the first rotation shaft with rotation motion following rotation of the first rotation shaft, and an outer spiral blade that is provided around the inner spiral blade and conveys the developer stored in the developer tank in a second direction among the axial line directions; and a developing roller that bears and conveys the developer, wherein the first developer conveying member is configured so that the first developer conveying direction is a same direction as the second direction, the inner spiral blade is a cone-shaped general spiral blade whose internal diameter is constant and external diameter becomes continuously smaller as advancing in the first direction, and the outer spiral blade is an annular general spiral blade whose external diameter is constant and internal diameter becomes continuously larger as advancing in the second direction.

6. The developing device of claim 5, wherein the first developer conveying member is configured so that a rotation direction of the first rotation shaft of the first conveying member, when viewed in the first developer conveying direction, is a right-handed direction when a direction of a flow of the developer stored in the developer tank is a right-handed direction in a case of being viewed from a vertically upper side of the developer tank, and a left-handed direction when a direction of a flow of the developer stored in the developer tank is a left-handed direction in a case of being viewed from a vertically upper side of the developer tank.

7. The developing device of claim 5, wherein the outer spiral blade is formed of an elastic sponge.

8. An electrophotographic image forming apparatus comprising the developing device of claim 5.

* * * * *